US008824698B2

(12) United States Patent
Takano et al.

(10) Patent No.: US 8,824,698 B2
(45) **Date of Patent: *Sep. 2, 2014**

(54) INTEGRATED CIRCUIT DEVICE, VOICE INPUT DEVICE AND INFORMATION PROCESSING SYSTEM

(75) Inventors: Rikuo Takano, Ibaraki (JP); Kiyoshi Sugiyama, Tokyo (JP); Toshimi Fukuoka, Kanagawa (JP); Masatoshi Ono, Ibaraki (JP); Ryusuke Horibe, Osaka (JP); Fuminori Tanaka, Osaka (JP); Takeshi Inoda, Osaka (JP)

(73) Assignees: Funai Electric Advanced Applied Technology Research Institute Inc., Osaka (JP); Funai Electric Co., Ltd., Osaka (JP)

( * ) Notice: Subject to any disclaimer, the term of this patent is extended or adjusted under 35 U.S.C. 154(b) by 891 days.

This patent is subject to a terminal disclaimer.

(21) Appl. No.: 12/994,147

(22) PCT Filed: May 20, 2009

(86) PCT No.: PCT/JP2009/059293

§ 371 (c)(1),
(2), (4) Date: Mar. 31, 2011

(87) PCT Pub. No.: WO2009/142250

PCT Pub. Date: Nov. 26, 2009

(65) Prior Publication Data

US 2011/0176690 A1 Jul. 21, 2011

(30) Foreign Application Priority Data

May 20, 2008 (JP) ..... P2008-132460

(51) Int. Cl.
*H04R 3/00* (2006.01)
*H04R 19/00* (2006.01)

(52) U.S. Cl.
CPC ..... *H04R 19/005* (2013.01); *H04R 3/005* (2013.01); *H04R 2499/11* (2013.01)
USPC ..... 381/92; 704/231; 381/94.1

(58) Field of Classification Search
CPC ..... H04R 3/005
USPC ..... 381/104, 92, 91, 355, 356, 369, 111, 381/170, 173, 174, 361, 362, 122; 455/569.1, 550.1; 29/294, 602.1; 704/200, 231, 251
See application file for complete search history.

(56) References Cited

U.S. PATENT DOCUMENTS 5,825,897 A * 10/1998 Andrea et al. ..... 381/71.6
5,969,838 A * 10/1999 Paritsky et al. ..... 398/136

(Continued)

FOREIGN PATENT DOCUMENTS

CN 1797544 A 7/2006
EP 0466676 A2 6/1991

(Continued)

OTHER PUBLICATIONS

Extended European Search Report for Application No. 09750612.5 dated Aug. 29, 2011 (9 pages).

(Continued)

*Primary Examiner* — Lun-See Lao
(74) *Attorney, Agent, or Firm* — Osha Liang LLP

(57) ABSTRACT

There is provided an integrated circuit device having a wiring board 1200', the wiring board 1200' including: a first vibrating membrane 714-1 which forms a first microphone; a second vibrating membrane 714-2 which forms a second microphone; and a differential signal generating circuit 720 which receives a first voltage signal obtained in the first microphone and a second voltage signal obtained in the second microphone and generates a differential signal indicating a difference between the first and second voltage signals, and a voice input device and an information processing system including the same. Accordingly, it is possible to realize a voice input element having a small size and a noise removal function with high accuracy.

7 Claims, 36 Drawing Sheets

(56) References Cited

U.S. PATENT DOCUMENTS

| | | | | |
|---|---|---|---|---|
| 7,092,539 | B2 * | 8/2006 | Sheplak et al. | 381/114 |
| 2003/0147538 | A1 | 8/2003 | Elko | |
| 2006/0140431 | A1 * | 6/2006 | Zurek | 381/355 |
| 2007/0047746 | A1 * | 3/2007 | Weigold et al. | 381/174 |
| 2007/0237345 | A1 * | 10/2007 | Zhang et al. | 381/113 |
| 2007/0253570 | A1 * | 11/2007 | Fukumoto et al. | 381/71.12 |
| 2008/0101625 | A1 | 5/2008 | Fazzio et al. | |

FOREIGN PATENT DOCUMENTS

| | | | |
|---|---|---|---|
| EP | 2094027 | A1 | 8/2009 |
| JP | 62-110349 | A | 5/1987 |
| JP | 64-051797 | A | 2/1989 |
| JP | 06269083 | A | 9/1994 |
| JP | 7-312638 | A | 11/1995 |
| JP | 8-256196 | A | 10/1996 |
| JP | 9-331377 | A | 12/1997 |
| JP | 2001-186241 | A | 7/2001 |
| JP | 2006-191359 | A | 7/2006 |
| JP | 2007-228300 | A | 9/2007 |
| WO | 01/37519 | A2 | 5/2001 |
| WO | 2004/098233 | A1 | 11/2004 |
| WO | 2006/062120 | A1 | 6/2006 |
| WO | 2008/062849 | A1 | 5/2008 |

OTHER PUBLICATIONS

Liaw et al., "Transducer Elements With a Semiconductor Cavity and Piezoelectric Film", Motorla, Technical Developments, Mar. 1997 (2 pages).

English Patent Abstract of Japanese Publication No. 06269083 Published Sep. 22, 1994 (1 page).

International Search Report w/translation from PCT/JP2009/059293 dated Jun. 23, 2009 (5 pages).

Written Opinion from PCT/JP2009/059293 dated Jun. 23, 2009 (5 pages).

Espacenet abstract Publication No. JP2007228300A dated Sep. 6, 2007 (1 page).

Espacenet abstract Publication No. WO2006062120A1 dated Jun. 15, 2006 (1 page).

Espacenet abstract Publication No. JP8156196A dated Oct. 1, 1996 (1 page).

Espacenet abstract Publication No. JP 2006191359A dated Jul. 20, 2006 (1 page).

Espacenet abstract Publication No. WO2008062849A1 dated May 29, 2008 (1 page).

Espacenet abstract Publication No. JP62110349A dated May 21, 1987 (1 page).

Espacenet abstract Publication No. JP7312638A dated Nov. 28, 1995 (1 page).

Espacenet abstract Publication No. JP9331377A dated Dec. 22, 1997 (1 page).

Espacenet abstract Publication No. JP2001186241A dated Jul. 6, 2001 (1 page).

Office Action issued in corresponding Chinese Application No. 200980118650.3 dated Mar. 5, 2013, and English translation thereof (14 pages).

* cited by examiner

1kHz

Δr=5mm

DISTANCE BETWEEN MICROPHONE AND SOUND SOURCE 2.5cm

1kHz

Δr=5mm

DISTANCE BETWEEN MICROPHONE AND SOUND SOURCE 1m

1kHz

Δr=10mm

DISTANCE BETWEEN MICROPHONE AND SOUND SOURCE 2.5cm

1kHz

Δr=10mm

DISTANCE BETWEEN MICROPHONE AND SOUND SOURCE 1m

1kHz

Δr=20mm

DISTANCE BETWEEN MICROPHONE AND SOUND SOURCE 2.5cm

1kHz

Δr=20mm

DISTANCE BETWEEN MICROPHONE AND SOUND SOURCE 1m

7kHz

Δr=5mm

DISTANCE BETWEEN MICROPHONE AND SOUND SOURCE 2.5cm

7kHz

Δr=5mm

DISTANCE BETWEEN MICROPHONE AND SOUND SOURCE 1m

7kHz

Δr=10mm

DISTANCE BETWEEN MICROPHONE AND SOUND SOURCE 2.5cm

7kHz

Δr=10mm

DISTANCE BETWEEN MICROPHONE AND SOUND SOURCE 1m

7kHz

Δr=20mm

DISTANCE BETWEEN MICROPHONE AND SOUND SOURCE 2.5cm

7kHz

Δr=20mm

DISTANCE BETWEEN MICROPHONE AND SOUND SOURCE 1m

300Hz

Δr=5mm

DISTANCE BETWEEN MICROPHONE AND SOUND SOURCE 2.5cm

300Hz

Δr=5mm

DISTANCE BETWEEN MICROPHONE AND SOUND SOURCE 1m

300Hz

Δr=10mm

DISTANCE BETWEEN MICROPHONE AND SOUND SOURCE 2.5cm

300Hz

Δr=10mm

DISTANCE BETWEEN MICROPHONE AND SOUND SOURCE 1m

300Hz

Δr=20mm

DISTANCE BETWEEN MICROPHONE AND SOUND SOURCE 2.5cm

300Hz

Δr=20mm

DISTANCE BETWEEN MICROPHONE AND SOUND SOURCE 1m

INTEGRATED CIRCUIT DEVICE, VOICE INPUT DEVICE AND INFORMATION PROCESSING SYSTEM

TECHNICAL FIELD

The present invention relates to an integrated circuit device, a voice input device and an information processing system.

BACKGROUND ART

It is desirable to pick up only a desired sound (a user's voice) during a telephone call or the like, and voice recognition, voice recording, or the like. However, a sound such as background noise, other than the desired sound, may also be present in any usage environment of a voice input device. Thus, there has been developed a voice input device having a noise removal function.

As a technique which removes a noise in a usage environment in which the noise is present, there has been known a technique which provides a microphone with sharp directivity, or a technique which detects a travel direction of sound waves using the difference between arrival times of the sound waves and removes noise through signal processing.

Further, in recent years, as electronic devices have been increasingly miniaturized, a technique which reduces the size of a voice input device has become important.

CITATION LIST

[PTL 1] JP-A-7-312638
[PTL 2] JP-A-9-331377
[PTL 3] JP-A 2001-186241

SUMMARY OF INVENTION

Technical Problem

In order to provide a microphone with sharp directivity, a multiplicity of vibrating membranes need to be disposed, which makes it difficult to achieve miniaturization.

Further, in order to detect the travel direction of sound waves with high accuracy using the difference between arrival times of the sound waves, a plurality of vibrating membranes should be installed at intervals corresponding to a fraction of several wavelengths of audible sound waves, which also makes it difficult to achieve miniaturization.

An object of the present invention is to provide an integrated circuit device, a voice input device (microphone element) and an information processing system which can realize a voice input element having a small size and a function of removing noises with high accuracy.

Solution to Problem (1) According to an embodiment of the present invention, there is provided an integrated circuit device having a wiring board, the wiring board including: a first vibrating membrane which forms a first microphone; a second vibrating membrane which forms a second microphone; and a differential signal generating circuit which receives a first voltage signal obtained in the first microphone and a second voltage signal obtained in the second microphone and generates a differential signal indicating a difference between the first and second voltage signals.

The first and second vibrating membranes and the differential signal generating circuit may be formed in the board, or may be mounted on the wiring board in a flip chip mounting method or the like.

The wiring board may be a semiconductor substrate, or may be a different circuit board made of glass epoxy or the like.

It is possible to suppress a difference in characteristics of both the microphones according to the environment such as temperature, by forming the first and second vibrating membranes on the same board.

Further, the differential signal generating circuit may be configured to have a function of adjusting a gain balance in two microphones. Accordingly, it is possible to adjust gain variation in both the microphones for every board for shipping.

According to the embodiment of the present invention, it is possible to generate a signal indicating a voice, from which a noise component is removed, by a simple process of merely generating a differential signal indicating a difference between two voltage signals.

Further, according to the embodiment of the present invention, it is possible to provide an integrated circuit device which has a small size through high density mounting and can realize a function of removing noise with high accuracy.

Further, the integrated circuit device according to the embodiment of the present invention can be applied as a voice input element (microphone element) of a close-talking voice input device. In this case, the first and second vibrating membranes of the integrated circuit device may be disposed so that a noise intensity ratio indicating the ratio of the intensity of the noise component included in the differential signal to the intensity of the noise component included in the first or second voltage signal is smaller than a voice intensity ratio indicating the ratio of the intensity of the input voice component included in the differential signal to the intensity of the input voice component included in the first or second voltage signal. Here, the noise intensity ratio may be an intensity ratio based on a phase difference component of noise, and the voice intensity ratio may be an intensity ratio based on an amplitude component of the input voice.

Further, this integrated circuit device (semiconductor substrate) may be configured as so-called MEMS (Micro-Electro-Mechanical Systems). Further, the vibrating membranes may be formed of an inorganic piezoelectric thin film or an organic piezoelectric thin film, so that a sound-electricity conversion can occur due to the piezoelectric effect.

(2) Further, in this integrated circuit device, it is preferable that the wiring board is a semiconductor substrate, and that the first and second vibrating membranes and the differential signal generating circuit are formed on the semiconductor substrate.

(3) Further, in this integrated circuit device, it is preferable that the wiring board is a semiconductor substrate, and that the first and second vibrating membranes are formed on the semiconductor substrate and the differential signal generating circuit is mounted on the semiconductor substrate in a flip chip mounting method.

It is possible to suppress a difference in characteristics of both the microphones due to the environment such as temperature by forming the first and second vibrating membranes on the same semiconductor substrate in this way.

The flip chip mounting is a mounting method in which an IC (Integrated Circuit) element or an IC chip is directly and electrically connected to the substrate in a batch in a state where a circuit surface of the IC element or the IC chip faces the substrate. Here, when the chip surface is electrically connected to the substrate through protruding terminals called bumps which are disposed in an array shape, not through wires in wire bonding, which makes it possible to reduce the mounting area compared with the wire bonding.

(4) Further, in this integrated circuit device, it is preferable that the first and second vibrating membranes and the differential signal generating circuit are mounted on the wiring board in a flip chip mounting method.

(5) Further, in this integrated circuit device, it is preferable that the wiring board is a semiconductor substrate, and that the differential signal generating circuit is formed on the semiconductor substrate and the first and second vibrating membranes are mounted on the semiconductor substrate in a flip chip mounting method.

(6) Further, in this integrated circuit device, it is preferable that an inter-center distance between the first and second vibrating membranes is 5.2 mm or less.

(7) Further, in this integrated circuit device, the vibrating membranes may be formed of vibrators having an SN ratio of about 60 decibels or higher. For example, the vibrating membranes may be formed of vibrators having an SN ratio of 60 decibels or higher, or may be formed of vibrators having an SN ratio of $60\pm\alpha$ decibels or higher.

(8) Further, in this integrated circuit device, an inter-center distance between the first and second vibrating membranes may be set to a distance in which a phase component of a voice intensity ratio which is the ratio of the intensity of a differential sound pressure of sound entering the first and second vibrating membranes to the intensity of a sound pressure of sound entering the first vibrating membrane, with respect to sound in a frequency band of 10 kHz or less, is equal to or smaller than zero decibels.

(9) Further, in this integrated circuit device, an inter-center distance between the first and second vibrating membranes may be set to a distance range in which a sound pressure in a case where the vibrating membranes are used as a differential microphone is not higher than a sound pressure in a case where the vibrating membranes are used as monolithic microphones in all directions, with respect to sound in an extraction target frequency band.

Here, the extraction target frequency refers to frequency of sound which is to be extracted in the sound input device. For example, the inter-center distance between the first and second vibrating membranes may be set using a frequency of 7 kHz or less as the extraction target frequency.

(10) Further, in this integrated circuit device, it is preferable that the first and second vibrating membranes are silicon films.

(11) Further, in this integrated circuit device, it is preferable that the first and second vibrating membranes are formed so that a normal direction to the first vibrating membrane and a normal direction to the second membrane are parallel with each other.

(12) Further, in this integrated circuit device, it is preferable that the first and second vibrating membranes are disposed at different positions in a direction which is perpendicular to the normal direction.

(13) Further, in this integrated circuit device, it is preferable that the first and second vibrating membranes are bottoms of concave sections formed in one surface of the semiconductor substrate.

(14) Further, in this integrated circuit device, it is preferable that the first and second vibrating membranes are disposed at different positions in a normal direction.

(15) Further, in this integrated circuit device, it is preferable that the first and second vibrating membranes are respectively bottoms of first and second concave sections formed in first and second surfaces of the semiconductor substrate, the first surface being opposite to the second surface.

(16) Further, in this integrated circuit device, at least one of the first and second vibrating membranes is configured to obtain sound waves through a sound guiding tube of a tubular shape which is installed perpendicularly to a surface of the membrane.

Here, the sound guiding tube is installed in close contact with the board around the vibrating membrane so that sound waves input through an opening can reach the vibrating membrane without leakage to the outside, and thus, the sound entering the sound guiding tube reach the vibrating membrane without being attenuated. Further, according to the embodiment of the present invention, it is possible to change the travel distance of sound until the sound reaches the vibrating membrane without attenuation due to diffusion by installing the sound guiding tube in at least one of the first and second vibrating membranes. That is, only the phase can be controlled in a state where the amplitude of sound in the inlet of the sound guiding tube is maintained. For example, it is possible to cancel a delay by installing a sound guiding tube having a suitable length (for example, several millimeters) according to the variation in the delay balance in two microphones.

(17) Further, in the integrated circuit device, it is preferable that the differential signal generating circuit includes: a gain section which gives a predetermined gain to the first voltage signal obtained in the first microphone; and a differential signal output section which generates and outputs, if the first voltage signal given the predetermined gain by the gain section and the second voltage signal obtained in the second microphone are input, a differential signal between the first voltage signal given the predetermined gain and the second voltage signal.

(18) Further, in the integrated circuit device, it is preferable that the differential signal generating circuit includes: an amplitude difference detecting section which receives the first voltage signal and the second voltage signal which are inputs of the differential signal output section, detects a difference between amplitudes of the first voltage signal and the second voltage signal, when the differential signal is generated, on the basis of the received first voltage signal and second voltage signal, and generates and outputs an amplitude difference signal on the basis of the detection result; and a control section which performs control to change an amplification factor in the gain section on the basis of the amplitude difference signal.

Here, the amplitude difference detecting section may include first amplitude detecting means which detects an output signal amplitude of the gain section, second amplitude detecting means which detects a signal amplitude of the second voltage signal obtained in the second microphone, and an amplitude difference signal generation m which detects a differential signal between the amplitude signal detected in the first amplitude detecting means and the amplitude signal detected in the second amplitude detecting means.

For example, a test sound source may be prepared for gain adjustment, the first and second microphones may be set so that sound from the sound source enters the first and second microphones with the same sound pressure, and the amplification factor may be changed so that the amplitudes are equal to each other or the difference between the amplitudes is within a predetermined range by monitoring (using an oscilloscope or the like, for example) waveforms of the first and second voltage signals output as the first and second microphones receive the sound.

Further, for example, the amplitude difference may be within the range of −3% or more and +3% or less, or within the range of −6% or more and +6% or less, with reference to the output signal of the gain section or the second voltage signal. In the former case, the noise suppression effect is about 10 decibels for the sound wave of 1 kHz, whereas in the latter case, the noise suppression effect is about 6 decibels, which makes it possible to achieve an appropriate suppression effect.

Alternatively, the predetermined gain may be controlled so that a noise suppression effect of predetermined decibels (for example, about 10 decibels) can be obtained.

According to the embodiments of the present invention, it is possible to detect variation in the gain balance in the microphones which varies according to usage situations (environments or age of service) on a real-time basis and to perform adjustment.

(19) Further, in the integrated circuit device, it is preferable that the differential signal generation section includes: a gain section which is configured to have an amplification factor changed according to the voltage applied to or the electric current flowing in a predetermined terminal; and a gain control section which controls the voltage applied to and the electric current flowing in the predetermined terminal, and that the gain control section includes a resistor array in which a plurality of resistors is connected in series or in parallel or includes at least one resistor, and is configured so that the voltage applied to or the electric current flowing in the predetermined terminal of the gain section can be changed by cutting a part of the resistors or conductors forming the resistor array or by cutting part of the at least one resistor.

The part of the resistors or conductors forming the resistor array may be cut by laser, or may be fused by application of high voltage or high electric current.

Further, it is preferable to detect variation in the gain balance due to an individual difference generated in a manufacturing process of the microphone and to determine the amplification factor of the first voltage signal so that the amplitude difference generated by the variation is cancelled. Then, the part of the resistors or conductors (fuses, for example) forming the resistor array is cut and a resistance value of the gain control section is set to a suitable value so that the voltage or the electric current which realizes the determined amplification factor can be supplied to a preset terminal. Thus, it is possible to adjust the amplitude balance in the output of the gain section and the second voltage signal obtained in the second microphone.

(20) Further, according to another embodiment of the present invention, there is provided a sound input device in which any one of the above-described integrated circuit devices is mounted.

According to this sound input device, it is possible to obtain a signal indicating an input signal from which a noise component is removed by merely generating a differential signal indicating the difference between two voltage signals. Thus, according to this embodiment, it is possible to provide a sound input device which is capable of realizing a voice recognition process, a voice authentication process, a command generation process based on an input voice, or the like with high accuracy.

(21) Further, according to another embodiment of the present invention, there is provided an information processing system including: any one of the above-described integrated circuit devices; and an analysis processing section which performs an analysis process of input voice information on the basis of the differential signal.

According to this information processing system, the analysis processing section performs the analysis process of the input voice information on the basis of the differential signal. Here, since the differential signal can be considered as a signal indicating a voice component from which a noise component is removed, it is possible to process a variety of information on the basis of the input voice by analyzing the differential signal.

Further, the information processing system according to this embodiment may be a system which performs a voice recognition process, a voice authentication process, a command generation process based on voice, or the like.

(22) Further, according to another embodiment of the present invention, there is provided an information processing system including: a sound input device which is mounted with any one of the above-described integrated circuit devices and a communication processing device which performs a communication process through a network; and a host computer which performs an analysis process of input sound information input to the sound input device on the basis of the differential signal obtained by the communication process through the network.

According to this information processing system, the analysis processing section performs the analysis process of the input voice information on the basis of the differential signal. Here, since the differential signal can be considered as a signal indicating a voice component from which a noise component is removed, it is possible to process a variety of information on the basis of the input voice by analyzing the differential signal.

Further, the information processing system according to this embodiment may be a system which performs a voice recognition process, a voice authentication process, a command generation process based on voice, or the like.

DESCRIPTION OF EMBODIMENTS

Hereinafter, embodiments according to the present invention will be described with the accompanying drawings. Here, the present invention is not limited to the embodiments below. Further, the present invention includes arbitrary combinations of elements of the following embodiments.

1. Configuration of Integrated Circuit Device

Firstly, a configuration of an integrated circuit device 1 according to an embodiment of the present invention will be described with reference to FIGS. 1 to 3. The integrated circuit device 1 according to the present embodiment is configured as a voice input element (microphone element) and can be applied to a close-talking voice input device or the like.

Figure 1:
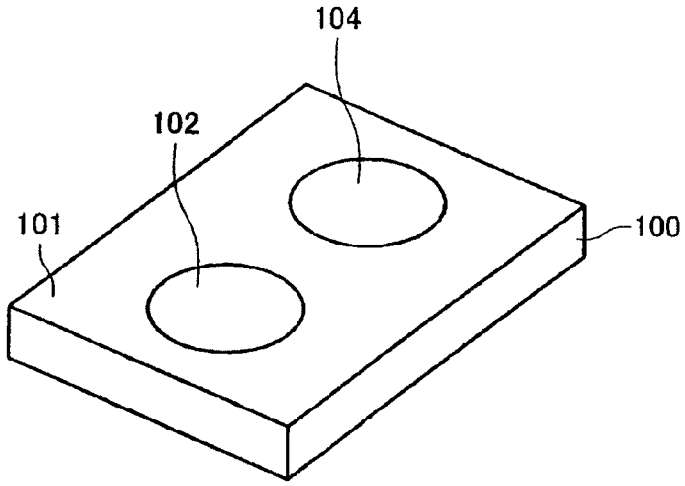
FIG. 1 is a diagram illustrating an integrated circuit device.
Figure 2:
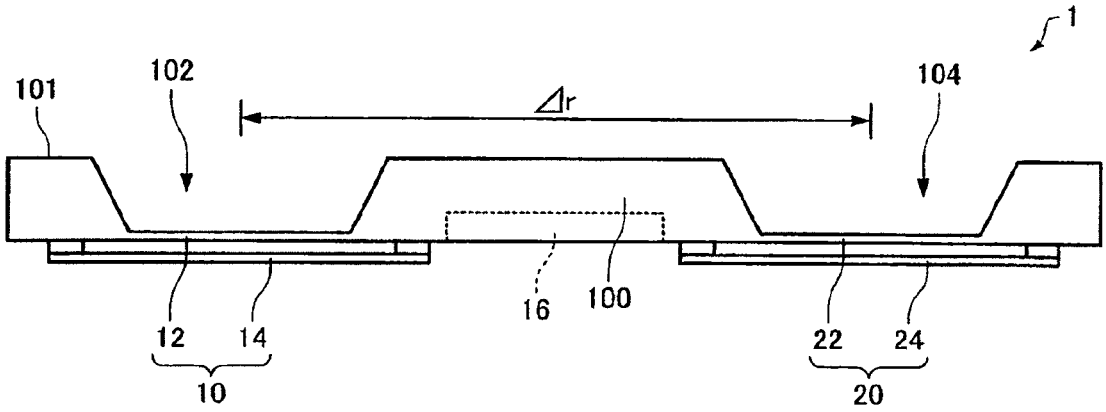
FIG. 2 is a diagram illustrating an integrated circuit device.
Figure 3:
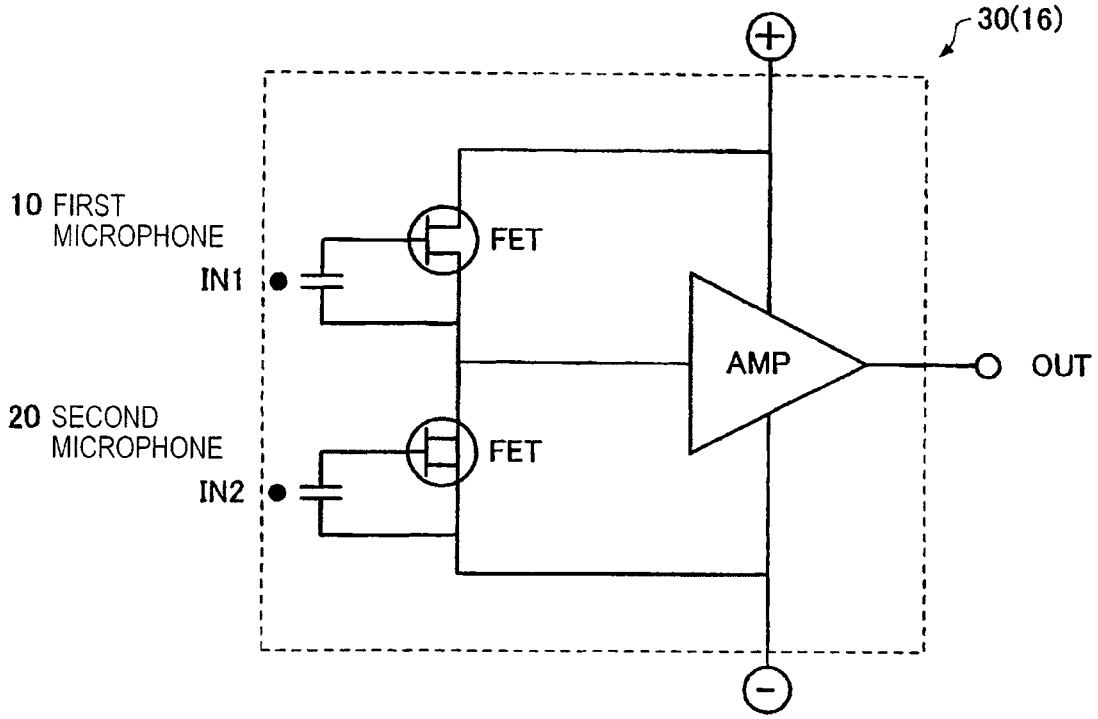
FIG. 3 is a diagram illustrating an integrated circuit device.

As shown in FIGS. 1 and 2, the integrated circuit device 1 according to the present embodiment includes a semiconductor substrate 100. FIG. 1 is a perspective view of the integrated circuit device 1 (semiconductor substrate 100), and FIG. 2 is a sectional view of the integrated circuit device 1. The semiconductor substrate 100 may be a semiconductor chip. Alternatively, the semiconductor substrate 100 may be a semiconductor wafer having a plurality of regions in which the integrated circuit apparatus 1 is to be formed. The semiconductor substrate 100 may be a silicon substrate.

A first vibrating membrane 12 is formed on the semiconductor substrate 100. The first vibrating membrane 12 may be the bottom of a first concave section 102 which is formed in a given surface 101 of the semiconductor substrate 100. The first vibrating membrane 12 is a vibrating membrane which forms a first microphone 10. That is, the first vibrating membrane 12 is formed to vibrate when sound waves are incident thereto, and makes a pair with a first electrode 14 disposed opposite to the first vibrating membrane 12 at an interval therefrom to form the first microphone 10. When sound waves are incident on the first vibrating membrane 12, the first vibrating membrane 12 vibrates so that the interval between the first vibrating membrane 12 and the first electrode 14 is changed. As a result, capacitance between the first vibrating membrane 12 and the first electrode 14 is changed. The sound waves (sound waves incident on the first vibrating membrane 12) that cause the first vibrating membrane 12 to vibrate can be converted into and output as an electrical signal (voltage signal) by outputting the change in capacitance as a change in voltage, for example. Hereinafter, the voltage signal output from the first microphone 10 is referred to as a first voltage signal.

A second vibrating membrane 22 is formed on the semiconductor substrate 100. The second vibrating membrane 22 may be the bottom of a second concave section 104 which is formed in a given surface 101 of the semiconductor substrate 100. The second vibrating membrane 22 is a vibrating membrane which forms a second microphone 20. That is, the second vibrating membrane 22 is formed to vibrate when sound waves are incident thereto, and makes a pair with a second electrode 24 disposed opposite to the second vibrating membrane 22 at an interval therefrom to form the second microphone 20. The second microphone 20 converts sound waves (sound waves incident on the second vibrating membrane 22) which cause the second vibrating membrane 22 to vibrate into a voltage signal and outputs the voltage signal in the same manner as the first microphone 10. Hereinafter, the voltage signal output from the second microphone 20 is referred to as a second voltage signal.

In this embodiment, the first and second vibrating membranes 12 and 22 are formed on the semiconductor substrate 100, and may be silicon films, for example. That is, the first and second microphones 10 and 20 may be silicon microphones (Si microphones). A reduction in size and an improvement in performance of the first and second microphones 10 and 20 can be achieved by utilizing the silicon microphones. The first and second vibrating membranes 12 and 22 may be disposed so that a normal direction to the first vibrating membrane 12 extends parallel with a normal direction to the second vibrating membrane 22. Further, the first and second vibrating membranes 12 and 22 may be disposed at different positions in a direction perpendicular to the normal direction.

The first and second electrodes 14 and 24 may be part of the semiconductor substrate 100, or may be conductors disposed on the semiconductor substrate 100. Further, the first and second electrodes 14 and 24 may have a structure which is not affected by sound waves. For example, the first and second electrodes 14 and 24 may have a mesh structure.

An integrated circuit 16 is formed on the semiconductor substrate 100. The configuration of the integrated circuit 16 is not particularly limited. However, for example, the integrated circuit 16 may include an active element such as a transistor and a passive element such as a resistor.

The integrated circuit device according to this embodiment includes a differential signal generating circuit 30. The differential signal generation circuit 30 receives the first voltage signal and the second voltage signal, and generates (outputs) a differential signal indicating the difference between the first voltage signal and the second voltage signal. The differential signal generation circuit 30 performs a process of generating the differential signal without performing an analysis process such as a Fourier analysis on the first and second voltage signals. The differential signal generation circuit 30 may be part of the integrated circuit 16 formed on the semiconductor substrate 100. FIG. 3 illustrates an example of a circuit diagram of the differential signal generation circuit 30. However, the circuit configuration of the differential signal generation circuit 30 is not limited thereto.

The integrated circuit device 1 according to this embodiment may further include a signal amplification circuit which provides (for example, increases or decreases) a predetermined gain to the differential signal. The signal amplification circuit may be part of the integrated circuit 16. Here, the integrated circuit device may not include the signal amplification circuit.

In the integrated circuit device 1 according to this embodiment, the first and second vibrating membranes 12 and 22 and the integrated circuit 16 (differential signal generation circuit 30) are formed on the single semiconductor substrate 100. The semiconductor substrate 100 may be considered as so-called MEMS (micro-electro-mechanical system). Further, the vibrating membranes may be made of an inorganic piezoelectric thin film or an organic piezoelectric thin film, so that sound-electricity conversion can be achieved using a piezoelectric effect. The first and second vibrating membranes 12 and 22 can be formed accurately and closely by forming the first and second vibrating membranes 12 and 22 on the same substrate (semiconductor substrate 100).

The vibrating membranes may include a vibrator having an SN (signal to noise) ratio of about 60 decibels or higher. In a case where the vibrator serves as a differential microphone, the SN ratio decreases compared with a case where the vibrator serves as a monolithic microphone. Thus, an integrated circuit device can be realized with high sensitivity by forming the vibrating membranes by the vibrator having a high SN ratio (for example, an MEMS vibrator having an SN ratio of 60 decibels or higher).

For example, in a case where a differential microphone which is configured by disposing two monolithic microphones to be separated by about 5 mm and by using the difference therebetween is used under the condition that a distance between a speaker and the microphone is about 2.5 cm (close-talking voice input device), the output sensitivity of the differential microphone decreases by about 10 decibels, compared with the case of the monolithic microphone. That is, in the differential microphone, compared with the monolithic microphone, the SB ratio decreases by at least 10 decibels. In consideration of utility of the microphone, an SN ratio of about 50 decibels is required. Thus, in the differential microphone, in order to satisfy this condition, the microphone should be configured by using a vibrator which can secure an SN ratio of about 60 decibels or higher in a monolithic state. Thus, it is possible to realize an integrated circuit device which satisfies the SN level required for the microphone function even in consideration of influence due to decrease in sensitivity.

The integrated circuit device 1 according to this embodiment performs a function of removing a noise component by utilizing the differential signal indicating the difference between the first and second voltage signals, as described later. The first and second vibrating membranes 12 and 22 may be disposed to satisfy predetermined conditions in order to realize the noise removal function with high accuracy. Details of the conditions which should be satisfied by the first and second vibrating membranes 12 and 22 will be described later. In this embodiment, the first and second vibrating membranes 12 and 22 may be disposed so that a noise intensity ratio is smaller than an input voice intensity ratio. Thus, the differential signal can be considered as a signal indicating a voice component from which a noise component is removed. The first and second vibrating membranes 12 and 22 may be disposed so that an inter-center distance Δr between the first and second vibrating membranes 12 and 22 is equal to or shorter than 5.2 mm, for example.

The integrated circuit device 1 according to this embodiment may be configured as described above. Accordingly, it is possible to provide an integrated circuit device which can realize a noise removal function with high accuracy. The principle of the noise removal will be described later.

2. Noise Removal Function

Hereinafter, the noise removal principle according to the integrated circuit device 1 and conditions in which the principle is realized will be described below.

(1) Noise Removal Principle

Firstly, the noise removal principle is described as follows.

Sound waves are attenuated during travel through a medium, so that the sound pressure (intensity and amplitude of the sound waves) decreases. Since a sound pressure is in inverse proportional to the distance from a sound source, a sound pressure P can be expressed by the following expression with respect to the relationship with a distance R from a sound source.

[Formula 1]

$$P = K\frac{1}{R} \tag{1}$$

Figure 4:
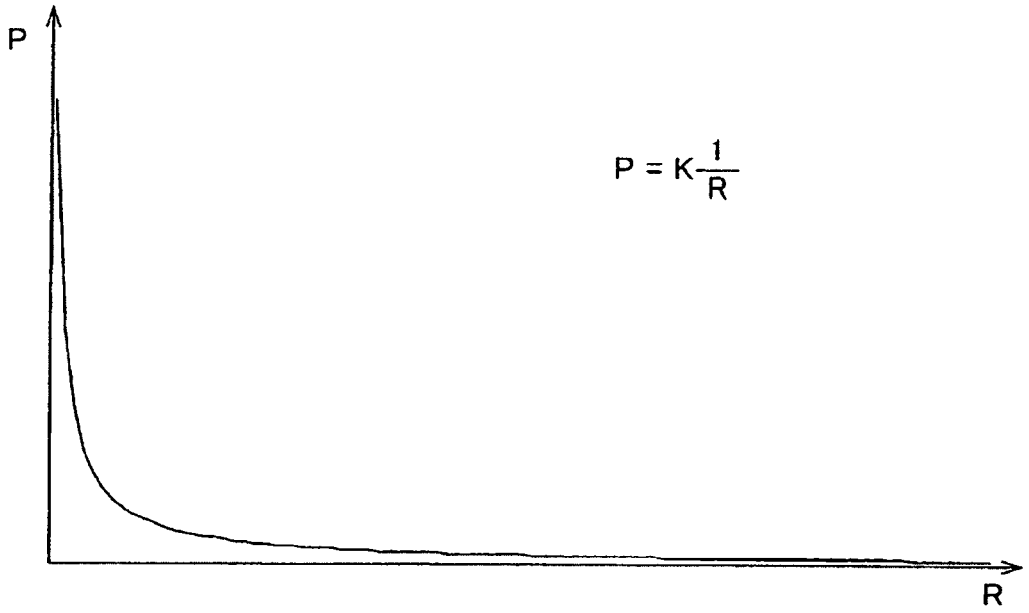
FIG. 4 is a diagram illustrating an integrated circuit device.

In expression (1), K is a proportional constant. FIG. 4 is a graph illustrating expression (1). However, as illustrated in FIG. 4, the sound pressure (amplitude of sound waves) is rapidly attenuated at a position near the sound source (left of the graph), and is gently attenuated as the distance from the sound source increases. The integrated circuit device according to this embodiment removes a noise component by using the attenuation characteristics.

That is, in a case where the integrated circuit device 1 is applied to a close-talking voice input device, a user talks at a position closer to the integrated circuit device 1 (first and second vibrating membranes 12 and 22) than a noise source. Thus, the user's voice is attenuated to a large extent between the first and second vibrating membranes 12 and 22, so that the user's voice included in the first voltage signal differs in intensity from the user's voice included in the second voltage signal. On the other hand, since the source of a noise component is disposed at a position which is distant from the integrated circuit device 1 as compared with the user's voice, the noise component is hardly attenuated between the first and second vibrating membranes 12 and 22. For this reason, it can be considered that a difference in intensity does not occur between the noise included in the first voltage signal and the noise included in the second voltage signal. Accordingly, by detecting the difference between the first and second voltage signals, the noise is removed and only the user's voice component produced near the integrated circuit device 1 remains. That is, the voltage signal (differential signal) indicating only the user's voice component without the noise component can be obtained by detecting the difference between the first and second voltage signals. Further, according to the integrated circuit device 1, a signal indicating the user's voice from which noise is removed with high accuracy can be obtained by performing a simple process that merely generates the differential signal indicating the difference between the two voltage signals.

Here, sound waves contain a phase component. Thus, the phase difference between the voice component and the noise component included in the first and second voltage signals should be taken into consideration in order to realize a noise removal function with high accuracy.

Hereinafter, specific conditions which should be satisfied by the integrated circuit device 1 in order to realize the noise removal function by generating the differential signal are described below.

(2) Specific Conditions Which Should be Satisfied by Integrated Circuit Device

According to the integrated circuit device 1, the differential signal indicating the difference between the first and second voltage signals is considered as an input voice signal which does not contain noise, as described above. According to the integrated circuit device, it can be evaluated that the noise removal function is realized when a noise component included in the differential signal has become smaller than a noise component included in the first or second voltage signal. Specifically, it can be evaluated that the noise removal function is realized when a noise intensity ratio indicating the ratio of the intensity of the noise component included in the differential signal to the intensity of the noise component included in the first or second voltage signal is smaller than a voice intensity ratio indicating the ratio of the intensity of the voice component included in the differential signal to the intensity of the voice component included in the first or second voltage signal.

Hereinafter, specific conditions which should be satisfied by the integrated circuit device 1 (first and second vibrating membranes 12 and 22) in order to realize the noise removal function are as follows.

Firstly, the sound pressure of a voice that enters the first and second microphones 10 and 20 (first and second vibrating membranes 12 and 22) will be described below. When the distance from the sound source of the input voice (user's voice) to the first vibrating membrane 12 is R, an inter-center distance between the first and second vibrating membranes 12 and 22 (first and second microphones 10 and 20) is Δr, and when the phase difference is disregarded, the sound pressures (intensities) P(S1) and P(S2) of the input voice obtained in the first and second microphones 10 and 20 can be expressed as follows.

[Formula 2]

$$\begin{cases} P(S1) = K\dfrac{1}{R} & (2) \\ P(S2) = K\dfrac{1}{R+\Delta R} & (3) \end{cases}$$

Therefore, when the phase difference of the input voice is disregarded, a voice intensity ratio ρ(P) indicating the ratio of the intensity of the input voice component included in the differential signal to the intensity of the input voice component obtained by the first microphone 10 is expressed as follows.

[Formula 3]

$$\rho(P) = \frac{P(S1) - P(S2)}{P(S1)} = \frac{\Delta r}{R + \Delta r} \quad (4)$$

Here, in a case where the integrated circuit device according to this embodiment is a microphone element used for a close-talking voice input device, Δr can be considered to be sufficiently smaller than R. Therefore, expression (4) can be transformed as follows.

[Formula 4]

$$\rho(P) = \frac{\Delta r}{R} \quad (A)$$

That is, it can be seen that the voice intensity ratio when the phase difference of the input voice is disregarded is expressed by expression A.

However, when the phase difference of the input voice is taken into consideration, sound pressures Q(S1) and Q(S2) of the user's voice can be expressed as follows.

[Formula 5]

$$\begin{cases} Q(S1) = K\frac{1}{R}\sin\omega t & (5) \\ Q(S2) = K\frac{1}{R + \Delta R}\sin(\omega t - \alpha) & (6) \end{cases}$$

In this expression, α represents the phase difference.

At this time, the voice intensity ratio ρ(S) is expressed as follows.

[Formula 6]

$$P(S) = \frac{|P(S1) - P(S2)|_{max}}{|P(S1)|_{max}} = \frac{\left|\frac{K}{R}\sin\omega t - \frac{K}{R + \Delta r}\sin(\omega t - \alpha)\right|_{max}}{\left|\frac{K}{R}\sin\omega t\right|_{max}} \quad (7)$$

In considering expression (7), the degree of the voice intensity ratio ρ(S) can be expressed as follows.

[Formula 7]

$$\rho(S) = \frac{\frac{K}{R}\left|\sin\omega t - \frac{K}{R + \Delta r}\sin(\omega t - \alpha)\right|_{max}}{\frac{K}{R}|\sin\omega t|_{max}} = \frac{1}{1 + \Delta r/R}|(1 + \Delta r/R)\sin\omega t - \sin(\omega t - \alpha)|_{max} = \frac{1}{1 + \Delta r/R}\left|\sin\omega t - \sin(\omega t - \alpha) + \frac{\Delta r}{R}\sin\omega t\right|_{max} \quad (8)$$

However, in expression (8), the term "sin ωt-sin(ωt-α)" indicates a phase component intensity ratio, and the term "Δr/R sin ωt" indicates an amplitude component intensity ratio. Since the phase difference component even in the case of the input voice component serves as noise for an amplitude component, the phase component intensity ratio should be sufficiently smaller than the amplitude component intensity ratio in order to accurately extract the input voice (user's voice). That is, it is necessary that "sin ωt-sin(ωt-α)" and "Δr/R sin ωt" should satisfy the relationship shown by expression B as below.

[Formula 8]

$$\left|\frac{\Delta r}{R}\sin\omega t\right|_{max} > |\sin\omega t - \sin(\omega t - \alpha)|_{max} \quad (B)$$

Here, the following relationship is satisfied.

[Formula 9]

$$\sin\omega t - \sin(\omega t - \alpha) = 2\sin\frac{\alpha}{2}\cdot\cos\left(\omega t - \frac{\alpha}{2}\right) \quad (9)$$

Thus, the above expression B can be expressed as follows.

[Formula 10]

$$\left|\frac{\Delta r}{R}\sin\omega t\right|_{max} = \left|2\sin\frac{\alpha}{2}\cdot\cos\left(\omega t - \frac{\alpha}{2}\right)\right|_{max} \quad (10)$$

In considering the amplitude component in expression (10), it can be understood that the integrated circuit device 1 according to this embodiment should satisfy the following expression.

[Formula 11]

$$\frac{\Delta r}{R} > 2\sin\frac{\alpha}{2} \quad (C)$$

As described above, since Δr can be considered to be sufficiently smaller than R, sin(α/2) can be considered to be sufficiently small, and can be approximated as the following expression.

[Formula 12]

$$\sin\frac{\alpha}{2} \approx \frac{\alpha}{2}$$

Therefore, expression (C) can be transformed as follows.

[Formula 13]

$$\frac{\Delta r}{R} > \alpha \quad (D)$$

Further, when the relationship between the phase difference α and Δr is expressed as follows,

[Formula 14]

$$\alpha = \frac{2\pi\Delta r}{\lambda} \tag{12}$$

expression (D) can be transformed as follows.

[Formula 15]

$$\frac{\Delta r}{R} > 2\pi\frac{\Delta r}{\lambda} > \frac{\Delta r}{\lambda} \tag{E}$$

That is, in this embodiment, it is necessary that the integrated circuit device 1 satisfies the relationship shown by expression (E) in order to accurately extract the input voice (user's voice).

Then, the sound pressure of noise that enters the first and second microphones 10 and 20 (first and second vibrating membranes 12 and 22) will be described below.

When amplitudes of noise components obtained by the first and second microphones 10 and 20 are A and A', sound pressures Q(N1) and Q(N2) of noise can be expressed as follows in consideration of a phase difference component.

[Formula 16]

$$\begin{cases} Q(N1) = A\sin\omega t & (13) \\ Q(N2) = A'\sin(\omega t - \alpha) & (14) \end{cases}$$

A noise intensity ratio ρ(N) indicating the ratio of the intensity of a noise component included in a differential signal to the intensity of a noise component obtained by the first microphone 10 can be expressed as follows.

[Formula 17]

$$\begin{aligned} \rho(N) &= \frac{|Q(N1) - Q(N2)|_{max}}{|Q(N1)|_{max}} \\ &= \frac{|A\sin\omega t - A'\sin(\omega t - \alpha)|_{max}}{|A\sin\omega t|_{max}} \end{aligned} \tag{15}$$

As described above, the amplitudes (intensities) of noise components obtained by the first and second microphones 10 and 20 are almost the same, and A can be considered to be equal to A'. Therefore, the above expression (15) can be transformed as follows.

[Formula 18]

$$\rho(N) = \frac{|\sin\omega t - \sin(\omega t - \alpha)|_{max}}{|\sin\omega t|_{max}} \tag{16}$$

Further, the degree of the noise intensity ratio can be expressed as follows.

[Formula 19]

$$\begin{aligned} \rho(N) &= \frac{|\sin\omega t - \sin(\omega t - \alpha)|_{max}}{|\sin\omega t|_{max}} \\ &= |\sin\omega t - \sin(\omega t - \alpha)|_{max} \end{aligned} \tag{17}$$

Here, in considering expression (9) above, expression (17) can be transformed as follows.

[Formula 20]

$$\begin{aligned} \rho(N) &= \left|\cos\left(\omega t - \frac{\alpha}{2}\right)\right|_{max} \cdot 2\sin\frac{\alpha}{2} \\ &= 2\sin\frac{\alpha}{2} \end{aligned} \tag{18}$$

Further, in considering expression (11), expression (18) can be transformed as follows.

[Formula 21]

$$\rho(N)=\alpha \tag{19}$$

Here, referring to expression (D), the degree of the noise intensity can be expressed as follows.

[Formula 22]

$$\rho(N) = \alpha < \frac{\Delta r}{R} \tag{F}$$

Here, Δr/R indicates the amplitude component intensity ratio of the input voice (user's voice), as indicated by expression A. In the integrated circuit device 1, the noise intensity ratio is smaller than the input voice intensity ratio Δr/R, as is clear from expression (F).

According to the integrated circuit device 1 in which the phase component intensity ratio of the input voice is smaller than the amplitude component intensity ratio (see expression B), the noise intensity ratio is smaller than the input voice intensity ratio (see expression (F)). In other words, according to the integrated circuit device 1 designed so that the noise intensity ratio is smaller than the input voice intensity ratio, it is possible to realize the noise removal function with high accuracy.

3. Method of Manufacturing Integrated Circuit Device

Hereinafter, a method of manufacturing the integrated circuit device according to this embodiment will be described. In this embodiment, the integrated circuit device may be manufactured using data indicating the correspondence relationship between a value of Δr/λ indicating the ratio of the inter-center distance Δr between the first and second vibrating membranes 12 and 22 to a wavelength λ of noise and a noise intensity ratio (intensity ratio based on the noise phase component).

The intensity ratio based on the noise phase component is expressed by the above expression (18). Therefore, a decibel value of the intensity ratio based on the noise phase component can be expressed as follows.

[Formula 23]

$$20\log\rho(N) = 20\log\left|2\sin\frac{\alpha}{2}\right| \quad (20)$$

Figure 5:
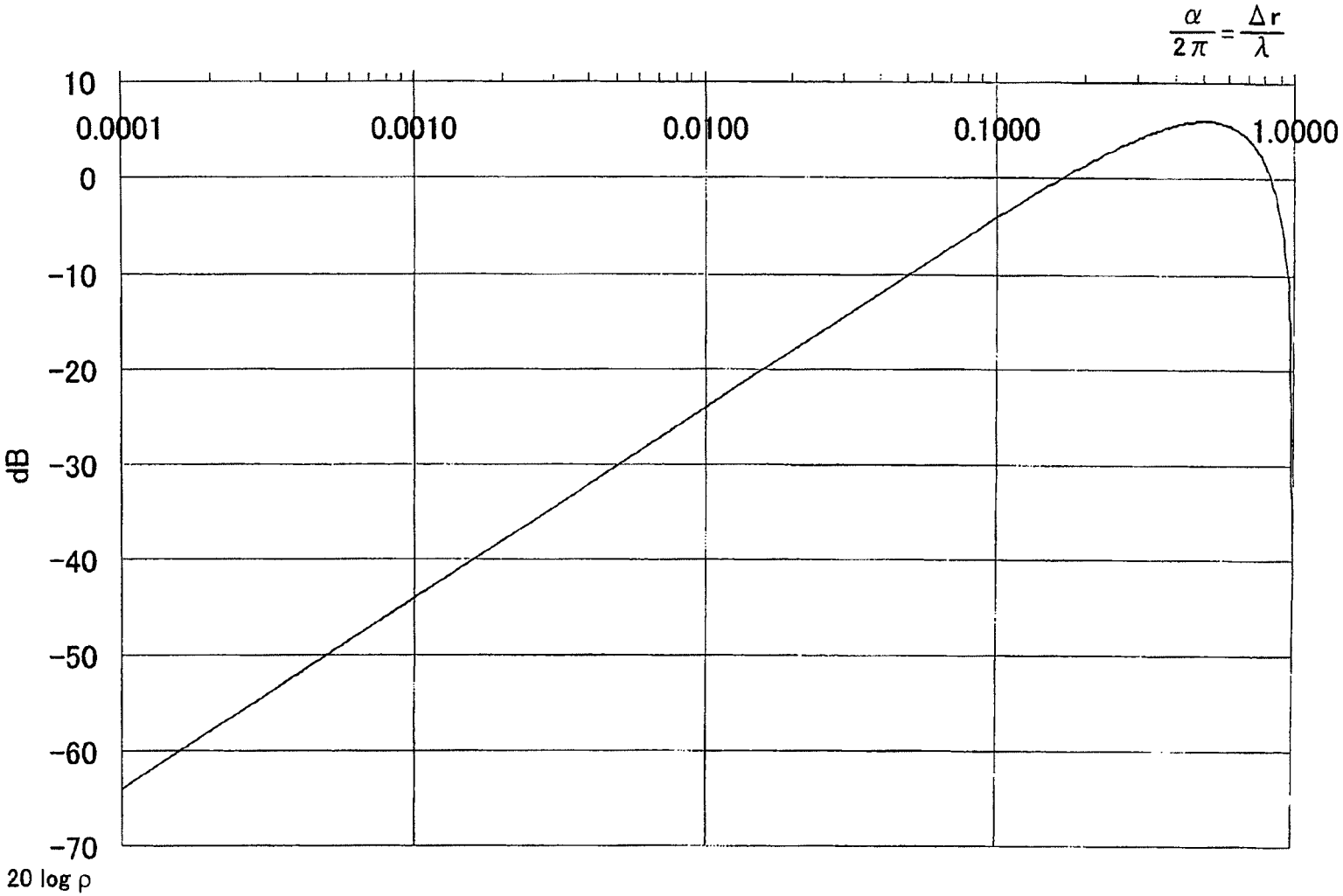
FIG. 5 is a diagram illustrating a method of manufacturing an integrated circuit device.

Further, the correspondence relationship between the phase difference $\alpha$ and the intensity ratio based on the phase component of noise can be clearly determined by substituting each value for a in expression (20). FIG. 5 illustrates an example of data indicating the correspondence relationship between the phase difference and the intensity ratio, when the horizontal axis indicates $\alpha/2\pi$ and the vertical axis indicates the intensity ratio (decibel value) based on the noise phase component.

As indicated by expression (12), the phase difference $\alpha$ can be expressed as a function of $\Delta r/\lambda$ indicating the ratio of the distance $\Delta r$ to a wavelength $\lambda$. The horizontal axis in FIG. 5 can be considered to indicate $\Delta r/\lambda$. That is, FIG. 5 illustrates data indicating the correspondence relationship between the intensity ratio based on the phase component of noise and $\Delta r/\lambda$.

Figure 6:
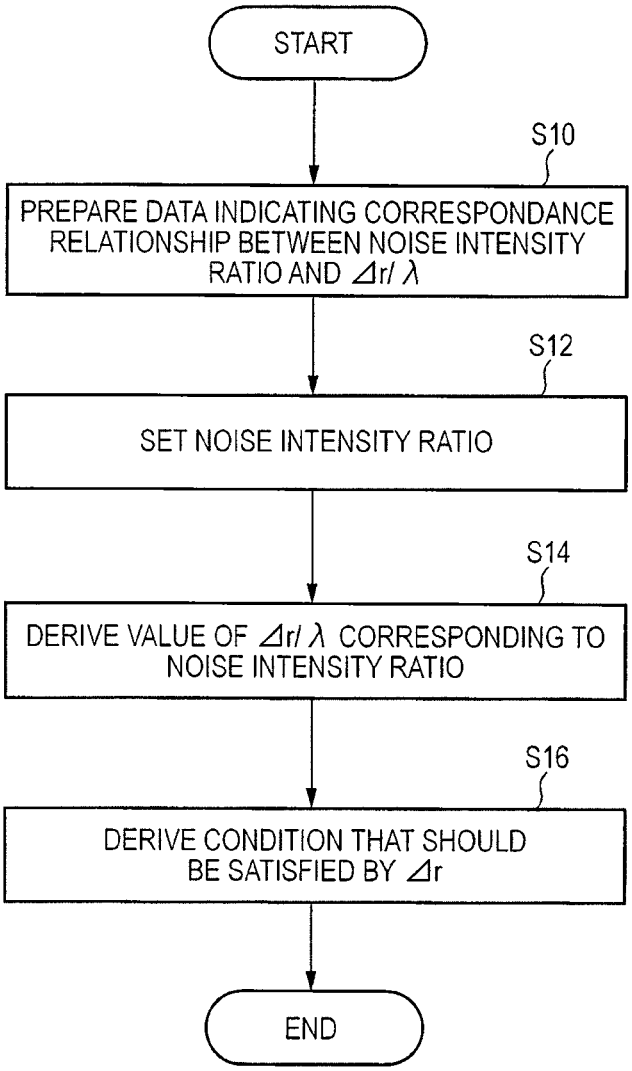
FIG. 6 is a diagram illustrating a method of manufacturing an integrated circuit device.

In this embodiment, the integrated circuit device 1 is manufactured using the above-mentioned data. FIG. 6 is a flowchart illustrating a procedure of manufacturing the integrated circuit device 1 using the above-mentioned data.

First, data (see FIG. 5) indicating the correspondence relationship between the noise intensity ratio (intensity ratio based on the phase component of noise) and the ratio $\Delta r/\lambda$ is prepared (step S10).

Then, the noise intensity ratio is set according to usage (step S12). In this embodiment, the noise intensity ratio should be set so that the noise intensity decreases. Thus, the noise intensity ratio is set to be 0 dB or less in this step.

Next, a value of $\Delta r/\lambda$ corresponding to the noise intensity ratio is derived on the basis of the data (step S14).

Further, a condition that should be satisfied by $\Delta r$ is derived by substituting the wavelength of main noise for 2 (step S16).

A specific example of manufacturing an integrated circuit device which reduces the intensity of noise by 20 dB in an environment where the main noise is 1 kHz and the wavelength of the noise is 0.347 m will be described below.

First, a condition in which it is necessary for the noise intensity ratio to become 0 dB or less is as follows. Referring to FIG. 5, it can be understood that the value of $\Delta r/\lambda$ is set to 0.16 dB or less in order to set the noise intensity ratio to 0 dB or less. That is, it can be understood that the value of $\Delta r$ is desirably set to 55.46 mm or less, which is a necessary condition for the integrated circuit device.

Next, a condition in which the intensity noise of 1 kHz is reduced by 20 dB is as follows. Referring to FIG. 5, the noise intensity can be reduced by 20 dB by setting the value of $\Delta r/\lambda$ to 0.015. Further, it can be understood that when $\lambda$=0.347 m, this condition is satisfied when the value of $\Delta r$ is about 5.2 mm or less. That is, an integrated circuit device having a noise removal function can be manufactured by setting the inter-center distance $\Delta r$ between the first and second vibrating membranes 12 and 22 (first and second microphones 10 and 20) to about 5.2 mm or less.

Since the integrated circuit device 1 according to this embodiment is used for a close-talking voice input device, the interval between the sound source of the user's voice and the integrated circuit device 1 (first or second vibrating membrane 12 or 22) is normally 5 cm or less. Further, the interval between the sound source of the user's voice and the integrated circuit device 1 (first and second vibrating membranes 12 and 22) can be controlled according to the design of the housing. Therefore, it can be understood that the value of the intensity ratio $\Delta r/R$ of the input voice (user's voice) is larger than 0.1 (noise intensity ratio) to thereby realize the noise removal function.

Normally, noise is not limited to a single frequency. However, since noise having a frequency lower than that of noise assumed as main noise is longer in wavelength than the main noise, the value of $\Delta r/\lambda$ decreases, so that the noise is removed by the integrated circuit device. Further, energy of sound waves is attenuated more quickly as the frequency becomes higher. Thus, since noise having a frequency higher than that of noise assumed as the main noise is attenuated more quickly than the main noise, the effect of the noise on the integrated circuit device can be disregarded. Therefore, it can be understood that the integrated circuit device according to this embodiment exhibits an excellent noise removal function even in an environment where noise having a frequency different from that of noise assumed as the main noise is present.

Further, this embodiment has been described assuming that noise enters along a straight line connecting the first and second vibrating membranes 12 and 22, as indicated by expression (12). The noise is noise in which apparent interval between the first and second vibrating membranes 12 and 22 becomes a maximum and the phase difference becomes largest in an actual usage environment. That is, the integrated circuit device 1 according to this embodiment is configured to be able to remove noise having the largest phase difference. For this reason, the integrated circuit device 1 according to this embodiment removes noise which enters from all directions.

4. Effects

The effects of the integrated circuit device 1 are summarized as follows.

As described above, according to the integrated circuit device 1, it is possible to obtain a voice component from which a noise component is removed by merely generating the differential signal indicating the difference between the voltage signals obtained by the first and second microphones 10 and 20. That is, the voice input device can realize a noise removal function without performing a complex analytical calculation process. Thus, it is possible to provide an integrated circuit device (microphone element or voice input element) capable of realizing a highly accurate noise removal function by a simple configuration.

Particularly, by setting the inter-center distance $\Delta r$ between the first and second vibrating membranes to 5.2 mm or less, it is possible to provide an integrated circuit device capable of realizing a highly accurate noise removal function without significant phase distortion.

Further, the inter-center distance between the first and second vibrating membranes may be set to a distance in which a phase component of a voice intensity ratio, which is the ratio of the differential sound pressure intensity of a voice which enters the first vibrating membrane and the second vibrating membrane to the sound pressure intensity of a voice incident to the first vibrating membrane, is 0 decibels or less, with respect to sound in a frequency band of 10 kHz or less.

The first and second vibrating membranes may be disposed along a travel direction of sound (for example, voice) of the sound source, and the inter-center distance between the first and second vibrating membranes may be set to a range distance in which the phase component of the sound pressure in a case where the vibrating membranes are used as differential microphones is used does not exceed the phase component of the sound pressure in a case where the vibrating membranes are used as monolithic microphones, with respect to sound having a frequency band of 10 kHz or less.

Delay distortion removal effects achieved by the integrated circuit device will be described.

As described above, the user voice intensity ratio ρ(S) is expressed by the following expression (8).

[Formula 24]

$$\rho(S) = \frac{\frac{K}{R}\left|\sin\omega t - \frac{K}{R+\Delta r}\sin(\omega t-\alpha)\right|_{max}}{\frac{K}{R}|\sin\omega t|_{max}} = \frac{1}{1+\Delta r/R}|(1+\Delta r/R)\sin\omega t - \sin(\omega t-\alpha)|_{max} = \frac{1}{1+\Delta r/R}\left|\sin\omega t - \sin(\omega t-\alpha) + \frac{\Delta r}{R}\sin\omega t\right|_{max} \quad (8)$$

Here, the phase component $\rho(S)_{phase}$ of the user voice intensity ρ(S) is the term "sin ωt-sin(ωw-α)".

[Formula 25]

$$\sin\omega t - \sin(\omega t-\alpha) = 2\sin\frac{\alpha}{2}\cdot\cos\left(\omega t - \frac{\alpha}{2}\right) \quad (9)$$

[Formula 26]

$$\frac{1}{1+\Delta r/R} \approx 1$$

If the above expressions are substituted for expression (8), then the phase component $\rho(S)_{phase}$ of the user voice intensity ρ(S) can be expressed by the following expression.

[Formula 27]

$$\rho(S)_{phase} = \left|\cos\left(\omega t - \frac{\alpha}{2}\right)\right|_{max}\cdot 2\sin\frac{\alpha}{2} = 2\sin\frac{\alpha}{2} \quad (21)$$

Accordingly, a decibel value of the intensity ratio based on the phase component $\rho(S)_{phase}$ of the user voice intensity ρ(S) can be expressed by the following expression.

[Formula 28]

$$20\log\rho(S)_{phase} = 20\log\left|2\sin\frac{\alpha}{2}\right| \quad (22)$$

Further, the correspondence relationship between the phase difference α and the intensity ratio based on the phase component of the user's voice can be clarified by substituting each value for a in expression (22).

Figure 26:
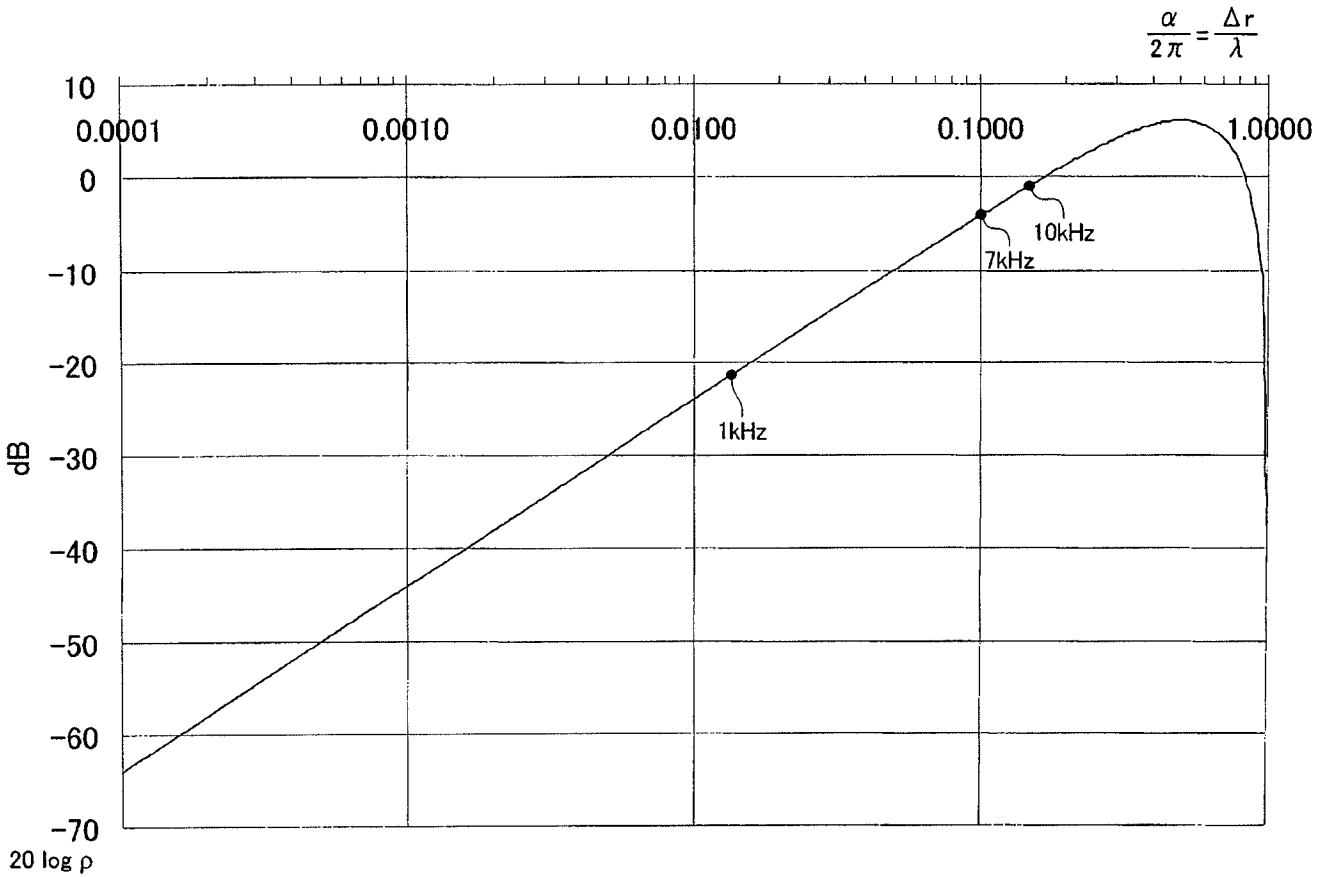
FIG. 26 is a diagram illustrating a distribution relationship of a phase component of a user voice intensity ratio in a case where a distance between microphones is 5 mm.
Figure 27:
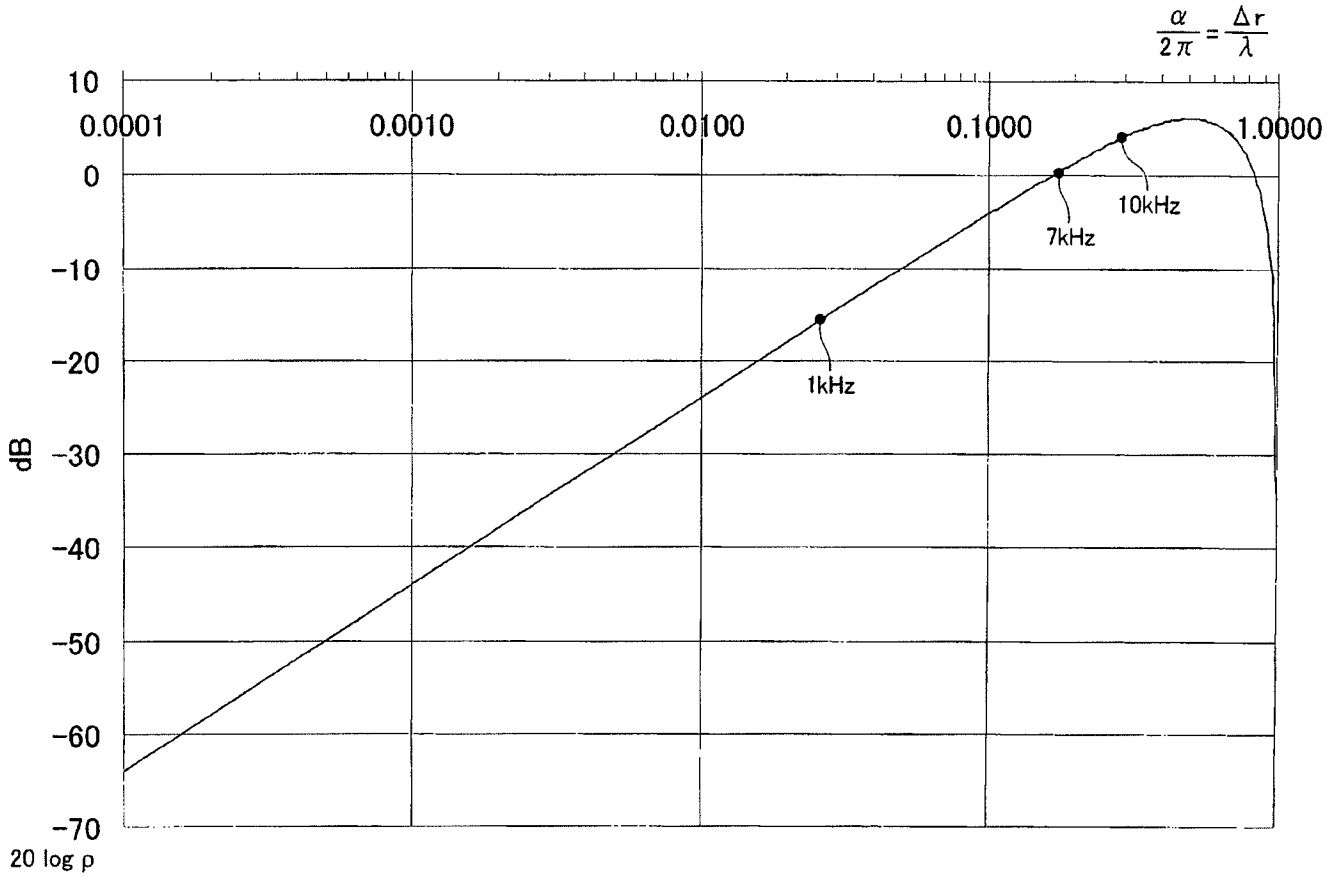
FIG. 27 is a diagram illustrating a distribution relationship of a phase component of a user voice intensity ratio in a case where a distance between microphones is 10 mm.
Figure 28:
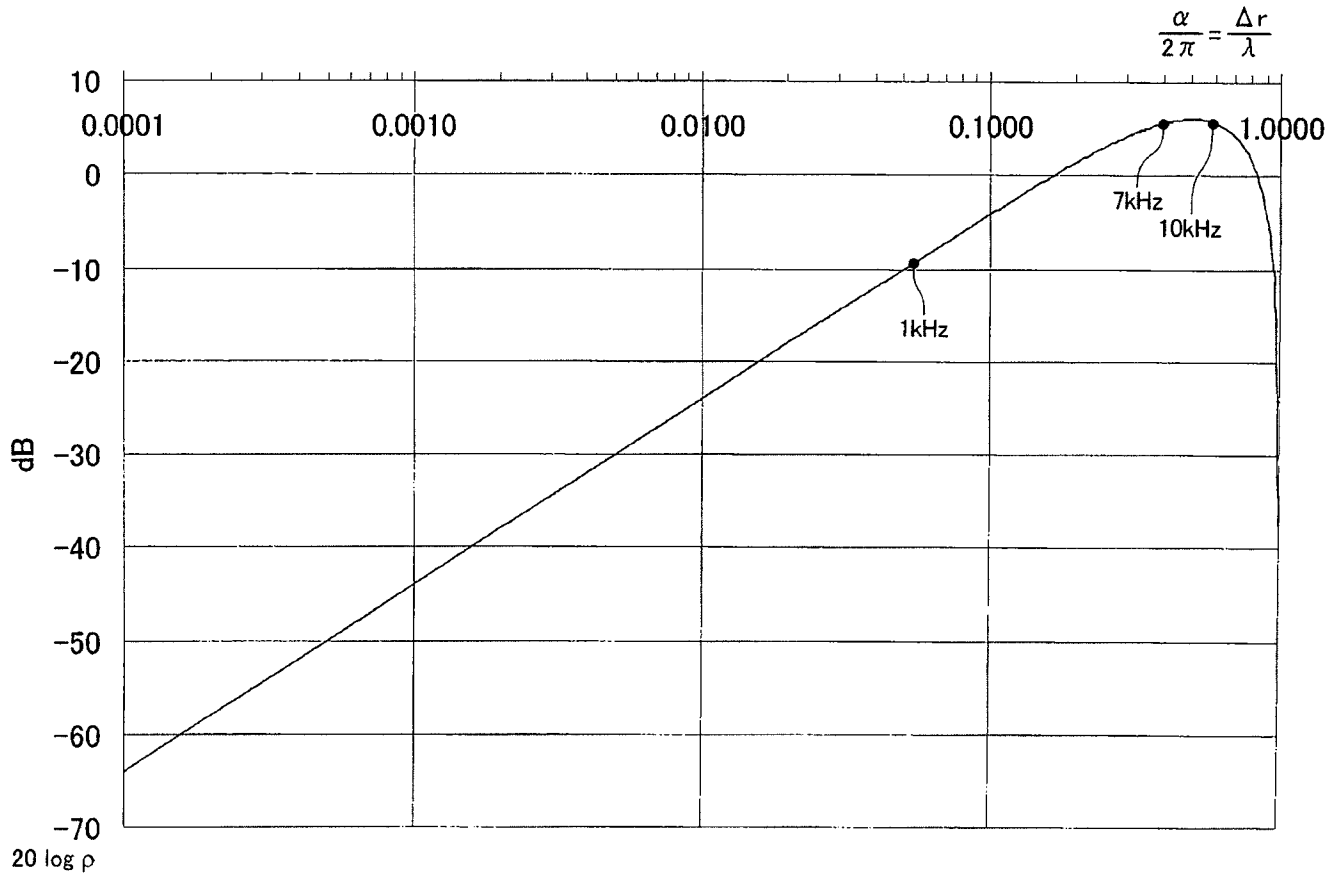
FIG. 28 is a diagram illustrating a distribution relationship of a phase component of a user voice intensity ratio in a case where a distance between microphones is 20 mm.

FIGS. 26 to 28 are diagrams illustrating the relationship between the distance between microphones and the phase component $\rho(S)_{phase}$ of the user voice intensity ration ρ(S). In FIGS. 26 to 28, the horizontal axis represents Δr/λ, and the vertical axis represents the phase component $\rho(S)_{phase}$ of the user voice intensity ratio ρ(S). The phase component $\rho(S)_{phase}$ of the user voice intensity ratio ρ(S) is a phase component of a sound pressure ratio of a differential microphone and a monolithic microphone (intensity ratio based on the phase component of the user voice), and is set to 0 decibels in a place where the sound pressure in a case where the microphone which forms the differential microphone is used as the monolithic microphone becomes the same as the differential sound pressure.

That is, in graphs shown in FIGS. 26 to 28 illustrating the transition of the differential sound pressure corresponding to Δr/λ, it can be considered that an area above a horizontal axis of 0 decibels has a large delay distortion (noise).

Currently telephone lines are designed in a voice frequency band of 3.4 kHz. However, in order to realize a higher quality of voice communication, it is necessary to adopt a voice frequency band of 7 kHz or higher, preferably, 10 kHz. Hereinafter, an influence of voice distortion due to a delay in a case where the voice frequency band of 10 kHz is adopted will be described.

FIG. 26 illustrates a distribution of the phase component $\rho(S)_{phase}$ of the user voice intensity ratio ρ(S) in a case where voices having frequencies of 1 kHz, 7 kHz, and 10 kHz are captured in the differential microphone, in a case where the distance between microphones (Δr) is 5 mm.

As shown in FIG. 26, in a case where the distance between microphones is 5 mm, the phase component $\rho(S)_{phase}$ of the user voice intensity ratio ρ(S) is 0 decibels or less, with respect to any voice having frequencies of 1 kHz, 7 kHz and 10 kHz.

Further, FIG. 27 illustrates a distribution of the phase component $\rho(S)_{phase}$ of the user voice intensity ratio ρ(S) in a case where voices having frequencies of 1 kHz, 7 kHz and 10 kHz are captured in the differential microphone, in a case where the distance between microphones (Δr) is 10 mm.

If the distance between microphones is 10 mm, as shown in FIG. 27, the phase component $\rho(S)_{phase}$ of the user voice intensity ratio ρ(S) is 0 decibels or less with respect to voices having frequencies of 1 kHz and 7 kHz, but the phase component $\rho(S)_{phase}$ of the user voice intensity ratio ρ(S) becomes 0 decibels or higher with respect to a voice having frequency of 10 kHz, so that delay distortion (noise) becomes large.

Further, FIG. 28 illustrates a distribution of the phase component $\rho(S)_{phase}$ of the user voice intensity ratio ρ(S) in a case where voices having frequencies of 1 kHz, 7 kHz, and 10 kHz are captured in the differential microphone, in a case where the distance between microphones (Δr) is 20 mm. If the distance between microphones becomes 20 mm, as shown in FIG. 28, the phase component $\rho(S)_{phase}$ of the user voice intensity ratio ρ(S) is 0 decibels or less with respect to a voice having frequency of 1 kHz, but the phase component $\rho(S)_{phase}$ of the user voice intensity ratio ρ(S) becomes 0 decibels or higher with respect to voices having frequencies of 7 kHz and 10 kHz, so that delay distortion (noise) becomes large.

Here, as the distance between microphones becomes short, the phase distortion of the voice of the speaker is suppressed, and its fidelity improves. However, the output level of the differential microphone is decreased, and thus, the SN ratio is decreased. Accordingly, in considering the fidelity, there is a problem of an optimal distance range between microphones.

Accordingly, by setting the distance between microphones to about 5 mm to 6 mm (more specifically, 5.2 mm or shorter), it is possible to reliably extract the voice of the speaker up to frequency of 10 kHz, to secure the SN ratio at a practical level, and to realize a voice input device which is capable of effectively suppressing distant noise.

In the present embodiment, by setting the inter-center distance of the first and second vibrating membranes to about 5 mm to 6 mm (more specifically, 5.2 mm or shorter), it is possible to reliably extract the voice of the speaker up to a frequency band of 10 kHz, and to realize an integrated circuit device which is capable of effectively suppressing distant noise.

Further, the first and second vibrating membranes 12 and 22 are disposed in the integrated circuit device 1, in order to remove the noise incident therein so that the noise intensity ratio based on the phase difference become the maximum. Thus, according to the integrated circuit device 1, the noise entering from all directions is removed. That is, according to the present embodiment, it is possible to provide an integrated circuit device which is capable of removing the noise entering from all directions.

FIGS. 29A to 37B are diagrams illustrating directivity of a differential microphone for each sound frequency, each distance between microphones and each distance between the microphone and a sound source.

Figure 29A:
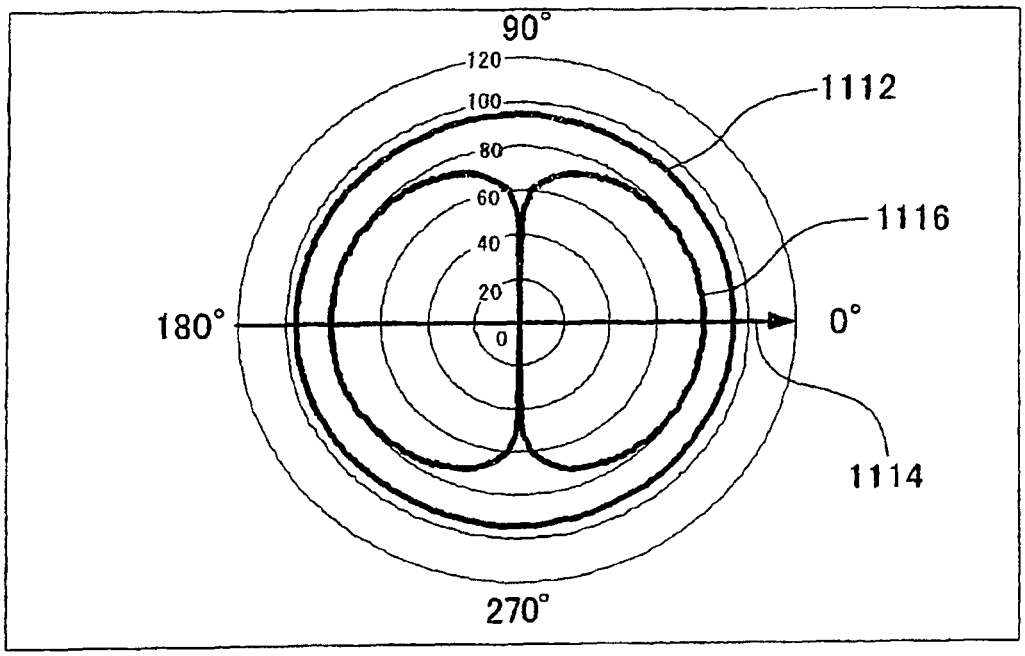
FIG. 29A is a diagram illustrating directivity of a differential microphone in a case where a distance between microphones is 5 mm, a sound source frequency is 1 kHz, and a distance between a microphone and a sound source is 2.5 cm.
Figure 29B:
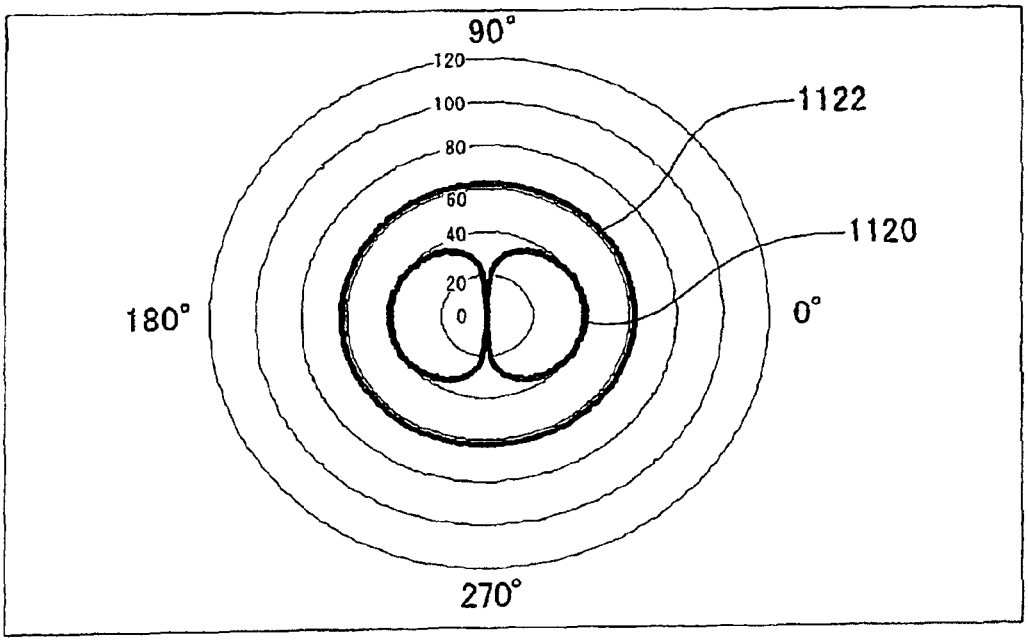
FIG. 29B is a diagram illustrating directivity of a differential microphone in a case where a distance between microphones is 5 mm, a sound source frequency is 1 kHz, and a distance between a microphone and a sound source is 1 m.

FIG. 29A and FIG. 29B are diagrams illustrating directivity of the differential microphone in a case where the sound source frequency is 1 kHz, the distance between the microphones is 5 mm, and the distance between the microphone and the sound source is 2.5 cm (corresponding to the distance from the mouth of the close-talking speaker to the microphone) and 1 m (corresponding to distant noise), respectively.

A reference numeral 1116 is a graph illustrating sensitivity (differential sound pressure) in all directions of the differential microphone, which represents the directivity of the differential microphone. Further, a reference numeral 1112 is a graph illustrating sensitivity (sound pressure) in all directions in a case where the differential microphone is used as a monolithic microphone, which represents an equivalent characteristic of the monolithic microphone.

A reference numeral 1114 represents a direction of a straight line connecting two microphones in a case where the differential microphone is configured by using two microphones, or a direction of a straight line connecting the first vibrating membrane and the second vibrating membrane which allows sound waves to reach opposite sides of the microphone in a case where the differential microphone is realized by one microphone (0 degree to 180 degrees, two microphones M1 and M2 or first and second vibrating membranes which forms the differential microphone are disposed on this straight line). The directions of the straight line are set to 0 degree and 180 degrees, and the directions perpendicular to the straight line are set to 90 degrees and 270 degrees.

As indicated by reference numerals 1112 and 1122, the monolithic microphone uniformly captures voice from all directions and does not have directivity. Further, as the sound source becomes distant, an obtained sound pressure is attenuated.

As indicated by in reference numerals 1116 and 1120, the differential microphone has a slightly low sensitivity in the directions of 90 degrees and 270 degrees, but has approximately uniform directivity in all directions. Further, an obtained sound pressure is attenuated compared with the monolithic microphone, and the obtained sound pressure is attenuated as the sound source becomes distant in a similar way to the monolithic microphone.

As shown in FIG. 29B, in a case where the frequency band of the sound source is 1 kHz and the distance between the microphones is 5 mm, an area indicated by the graph 1120 of the differential sound pressure indicating the directivity of the differential microphone is included in an area indicated by the graph 1122 indicating the equivalent characteristic of the monolithic microphone, and the differential microphone has an excellent suppression effect of the distant noise compared with the monolithic microphone.

Figure 30A:
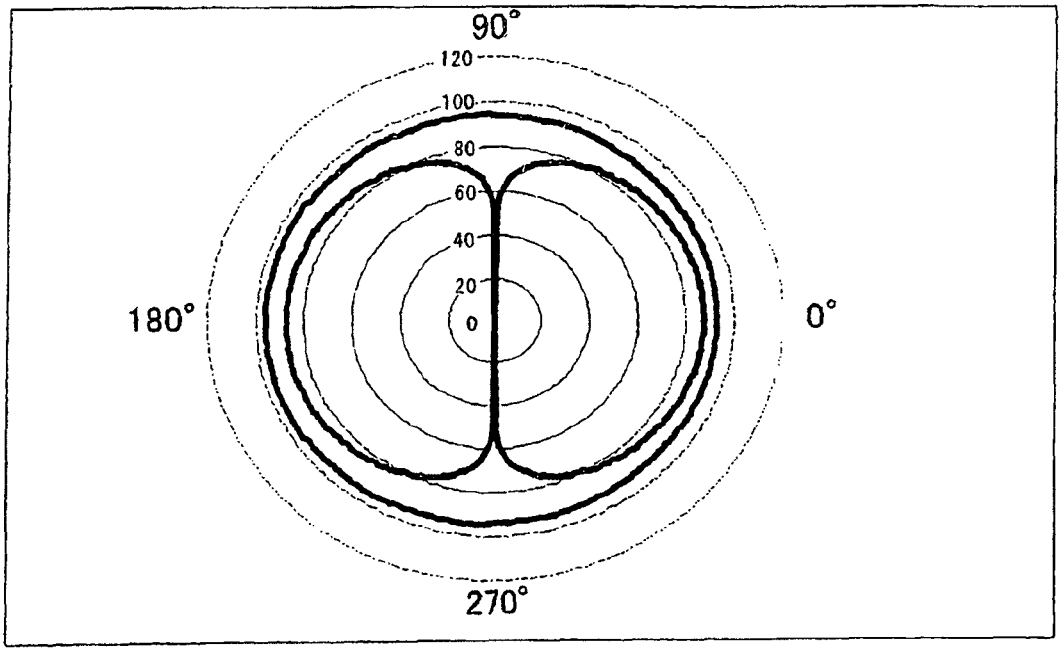
FIG. 30A is a diagram illustrating directivity of a differential microphone in a case where a distance between microphones is 10 mm, a sound source frequency is 1 kHz, and a distance between a microphone and a sound source is 2.5 cm.
Figure 30B:
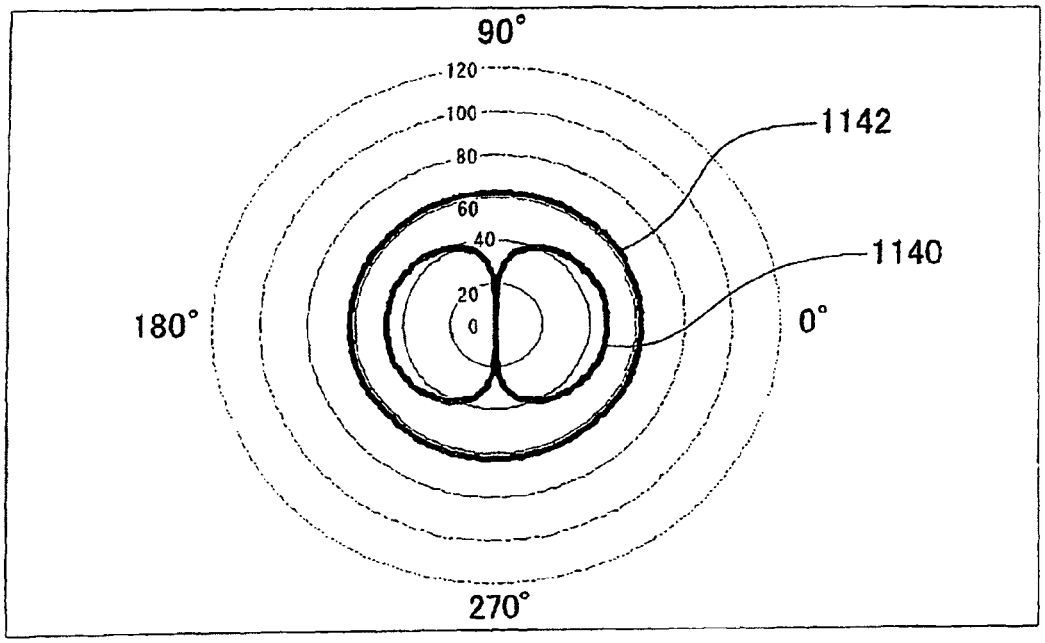
FIG. 30B is a diagram illustrating directivity of a differential microphone in a case where a distance between microphones is 10 mm, a sound source frequency is 1 kHz, and a distance between a microphone and a sound source is 1 m.

FIGS. 30A and 30B are diagrams illustrating directivity of the differential microphone in a case where the sound source frequency is 1 kHz, the distance Δr between the microphones is 10 mm, and the distance between the microphone and the sound source is 2.5 cm and 1 m, respectively. In this case, as shown in FIG. 30B, an area indicated by a graph 1140 indicating the directivity of the differential microphone is included in an area indicated by a graph 1422 indicating the equivalent characteristic of the monolithic microphone, and the differential microphone has an excellent suppression effect of the distant noise compared with the monolithic microphone.

Figure 31A:
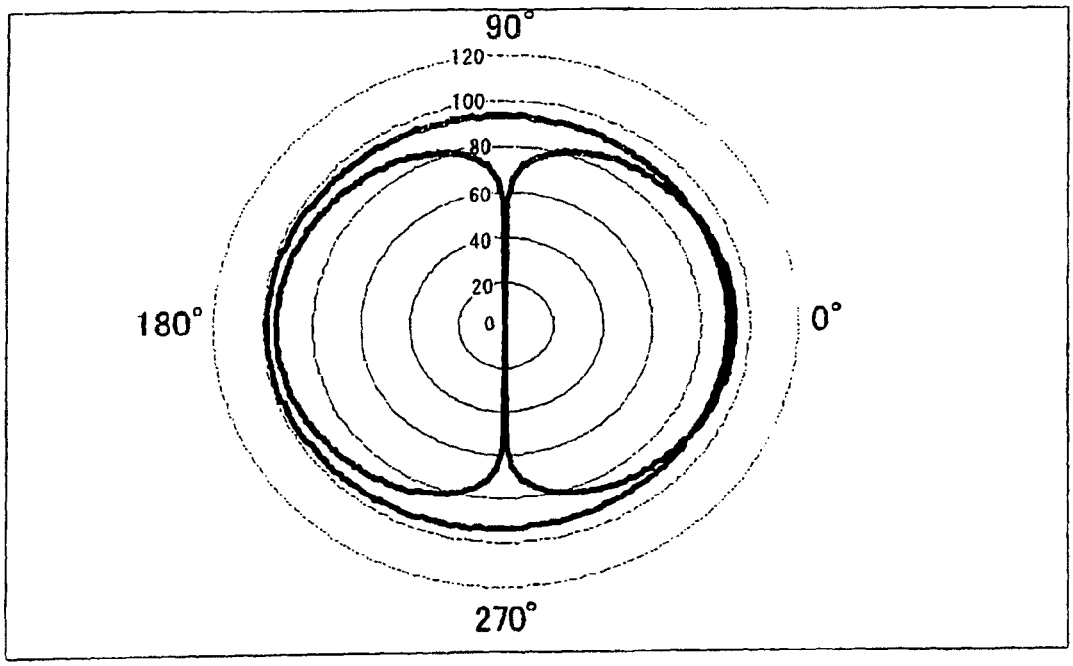
FIG. 31A is a diagram illustrating directivity of a differential microphone in a case where a distance between microphones is 20 mm, a sound source frequency is 1 kHz, and a distance between a microphone and a sound source is 2.5 cm.
Figure 31B:
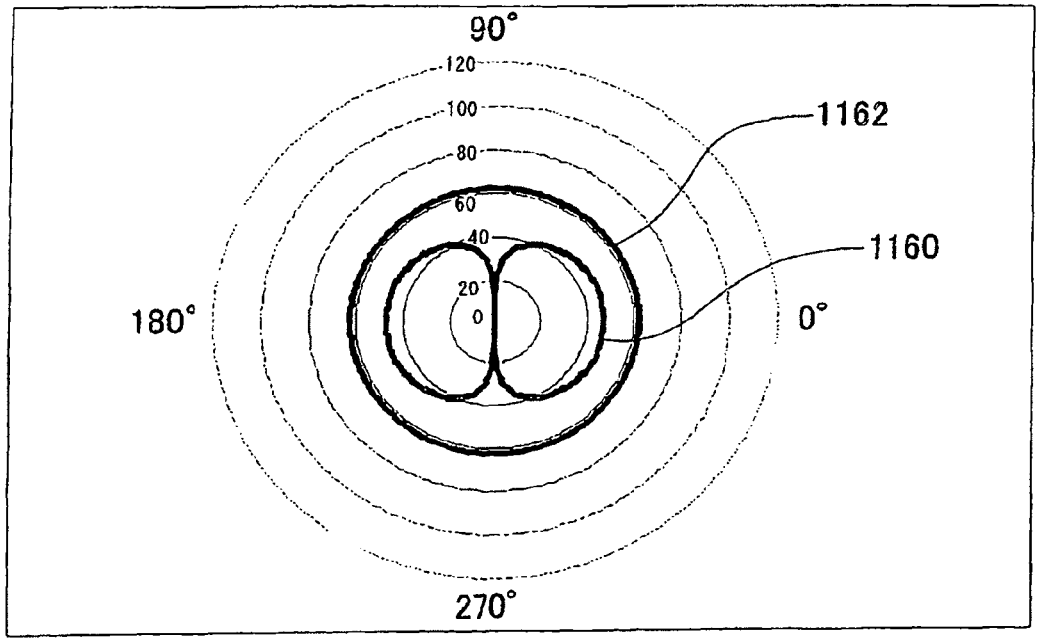
FIG. 31B is a diagram illustrating directivity of a differential microphone in a case where a distance between microphones is 20 mm, a sound source frequency is 1 kHz, and a distance between a microphone and a sound source is 1 m.

FIGS. 31A and 31B are diagrams illustrating directivity of the differential microphone in a case where the sound source frequency is 1 kHz, the distance Δr between the microphones is 20 mm, and the distance between the microphone and the sound source is 2.5 cm and 1 m, respectively. In this case, as shown in FIG. 31B, an area indicated by a graph 1160 indicating the directivity of the differential microphone is included in an area indicated by a graph 1462 indicating the equivalent characteristic of the monolithic microphone, and the differential microphone has an excellent suppression effect of the distant noise compared with the monolithic microphone.

Figure 32A:
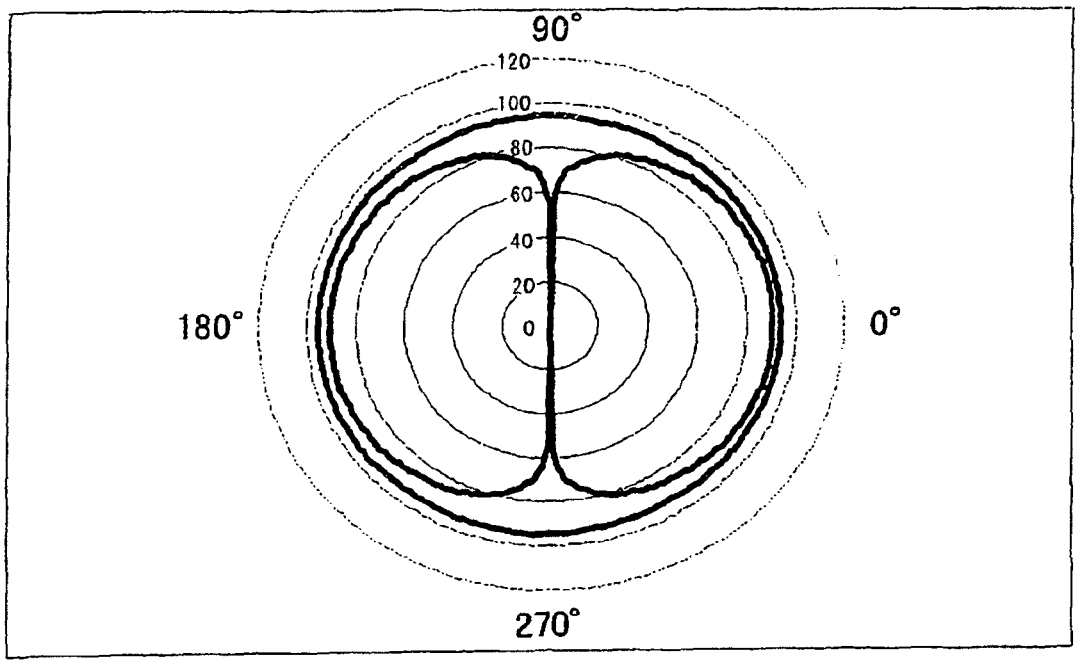
FIG. 32A is a diagram illustrating directivity of a differential microphone in a case where a distance between microphones is 5 mm, a sound source frequency is 7 kHz, and a distance between a microphone and a sound source is 2.5 cm.
Figure 32B:
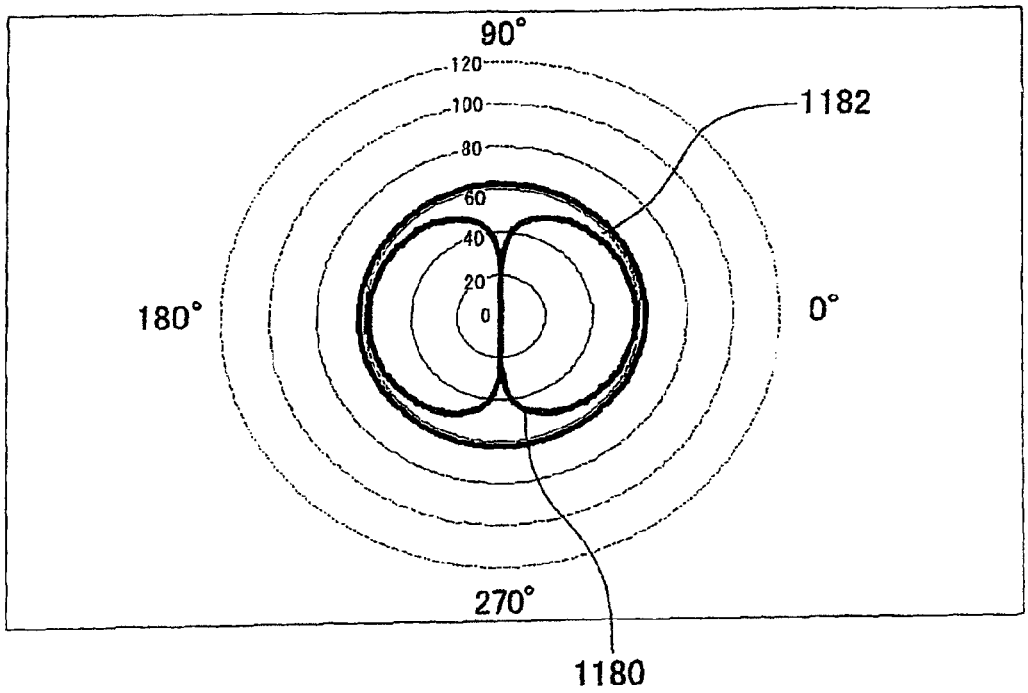
FIG. 32B is a diagram illustrating directivity of a differential microphone in a case where a distance between microphones is 5 mm, a sound source frequency is 7 kHz, and a distance between a microphone and a sound source is 1 m.

FIGS. 32A and 32B are diagrams illustrating directivity of the differential microphone in a case where the sound source frequency is 7 kHz, the distance Δr between the microphones is 5 mm, and the distance between the microphone and the sound source is 2.5 cm and 1 m, respectively. In this case, as shown in FIG. 32B, an area indicated by a graph 1180 indicating the directivity of the differential microphone is included in an area indicated by a graph 1182 indicating the equivalent characteristic of the monolithic microphone, and the differential microphone has an excellent suppression effect of the distant noise compared with the monolithic microphone.

Figure 33A:
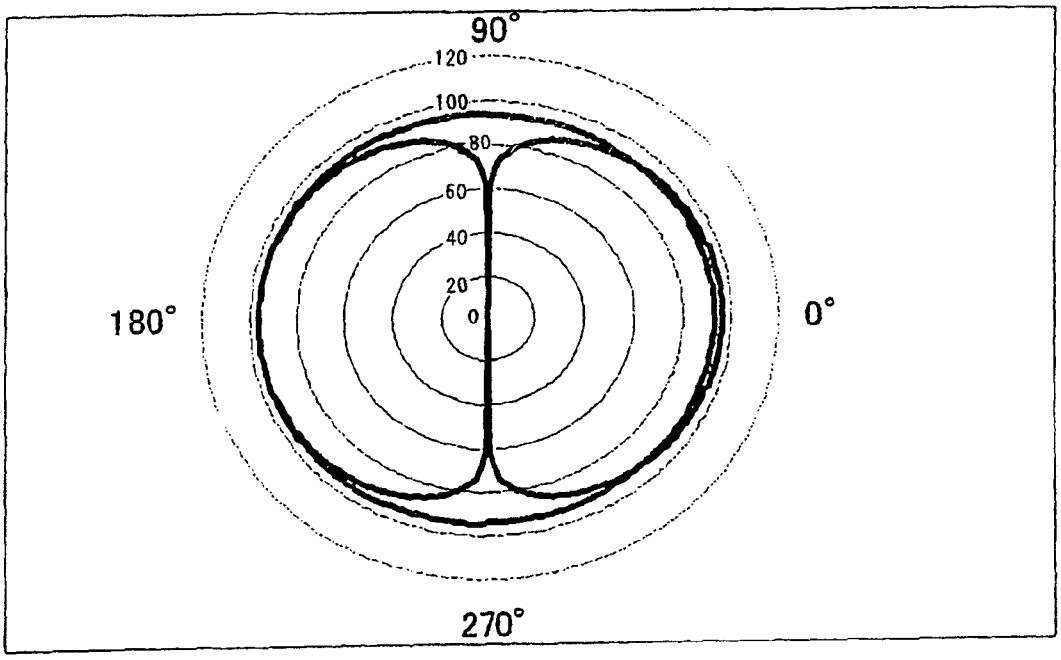
FIG. 33A is a diagram illustrating directivity of a differential microphone in a case where a distance between microphones is 10 mm, a sound source frequency is 7 kHz, and a distance between a microphone and a sound source is 2.5 cm.
Figure 33B:
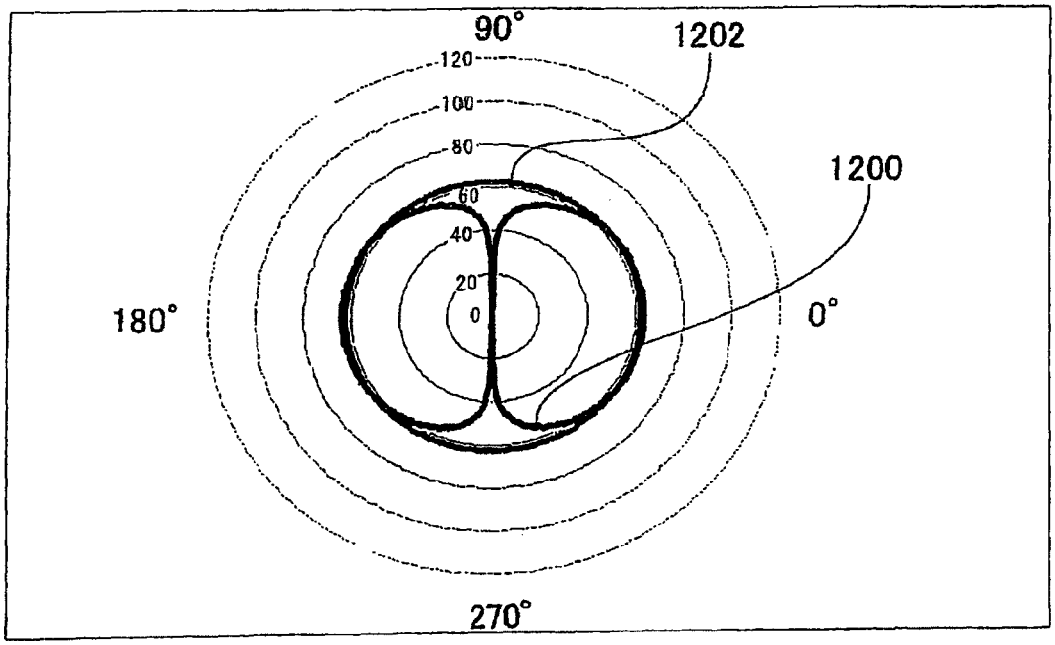
FIG. 33B is a diagram illustrating directivity of a differential microphone in a case where a distance between microphones is 10 mm, a sound source frequency is 7 kHz, and a distance between a microphone and a sound source is 1 m.

FIGS. 33A and 33B are diagrams illustrating directivity of the differential microphone in a case where the sound source frequency is 7 kHz, the distance Δr between the microphones is 10 mm, and the distance between the microphone and the sound source is 2.5 cm and 1 m, respectively. In this case, as shown in FIG. 33B, an area indicated by a graph 1200 indicating the directivity of the differential microphone is not included in an area indicated by a graph 1202 indicating the equivalent characteristic of the monolithic microphone, and the differential microphone does not have an excellent suppression effect on the distant noise compared with the monolithic microphone.

Figure 34A:
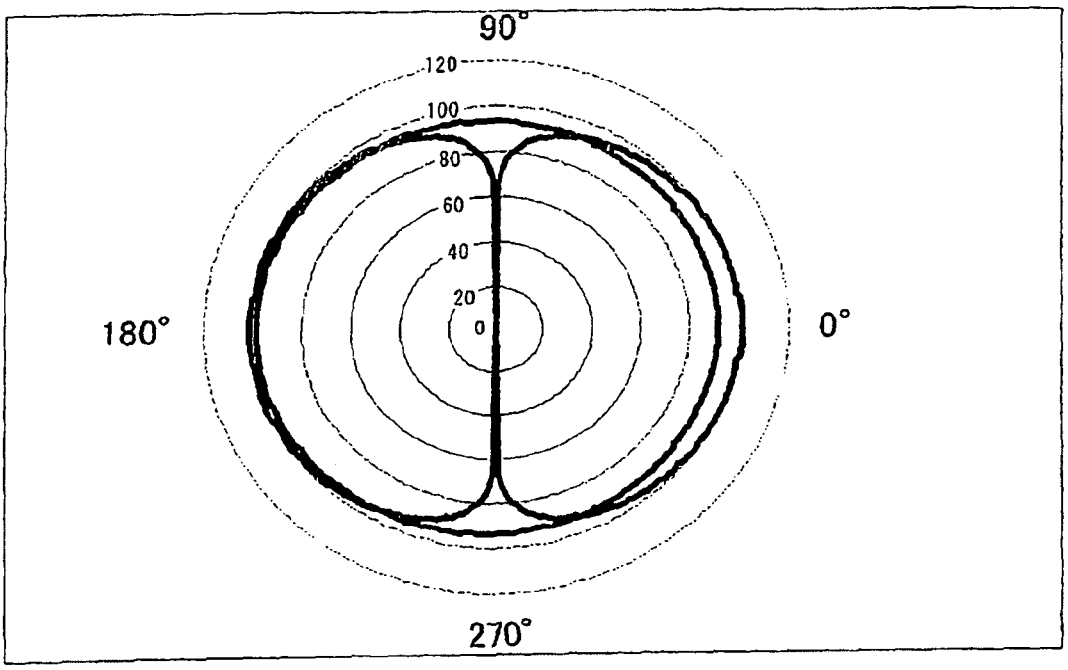
FIG. 34A is a diagram illustrating directivity of a differential microphone in a case where a distance between microphones is 20 mm, a sound source frequency is 7 kHz, and a distance between a microphone and a sound source is 2.5 cm.
Figure 34B:
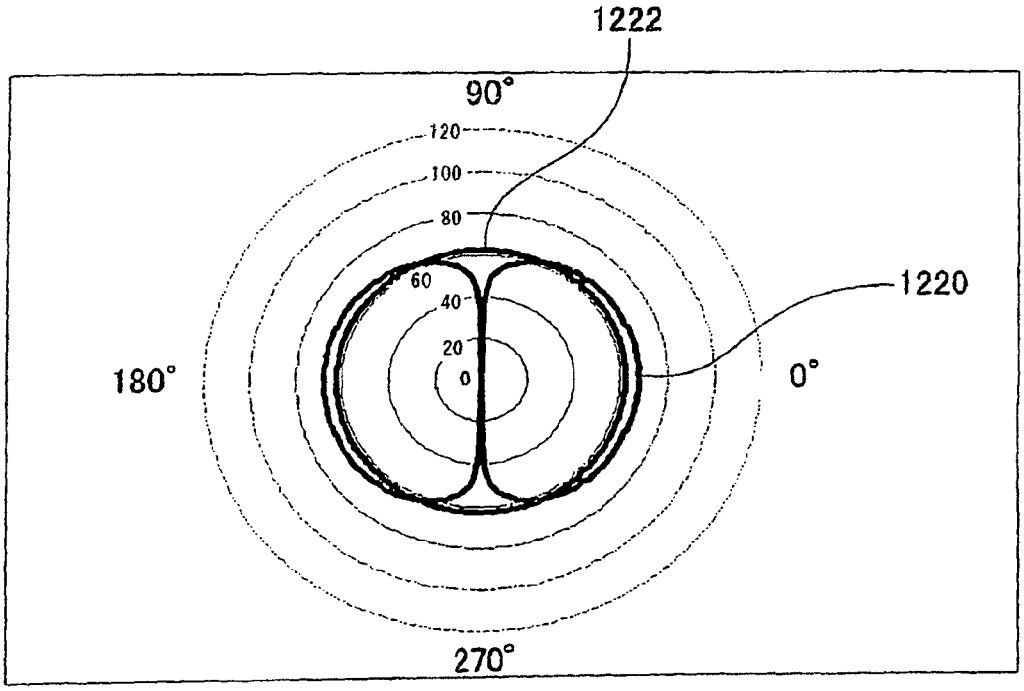
FIG. 34B is a diagram illustrating directivity of a differential microphone in a case where a distance between microphones is 20 mm, a sound source frequency is 7 kHz, and a distance between a microphone and a sound source is 1 m.

FIGS. 34A and 34B are diagrams illustrating directivity of the differential microphone in a case where the sound source frequency is 7 kHz, the distance Δr between the microphones is 20 mm, and the distance between the microphone and the sound source is 2.5 cm and 1 m, respectively. In this case, as shown in FIG. 34B, an area indicated by a graph 1220 indicating the directivity of the differential microphone is not also included in an area indicated by a graph 1222 indicating the equivalent characteristic of the monolithic microphone, and the differential microphone does not have an excellent suppression effect of the distant noise compared with the monolithic microphone.

Figure 35A:
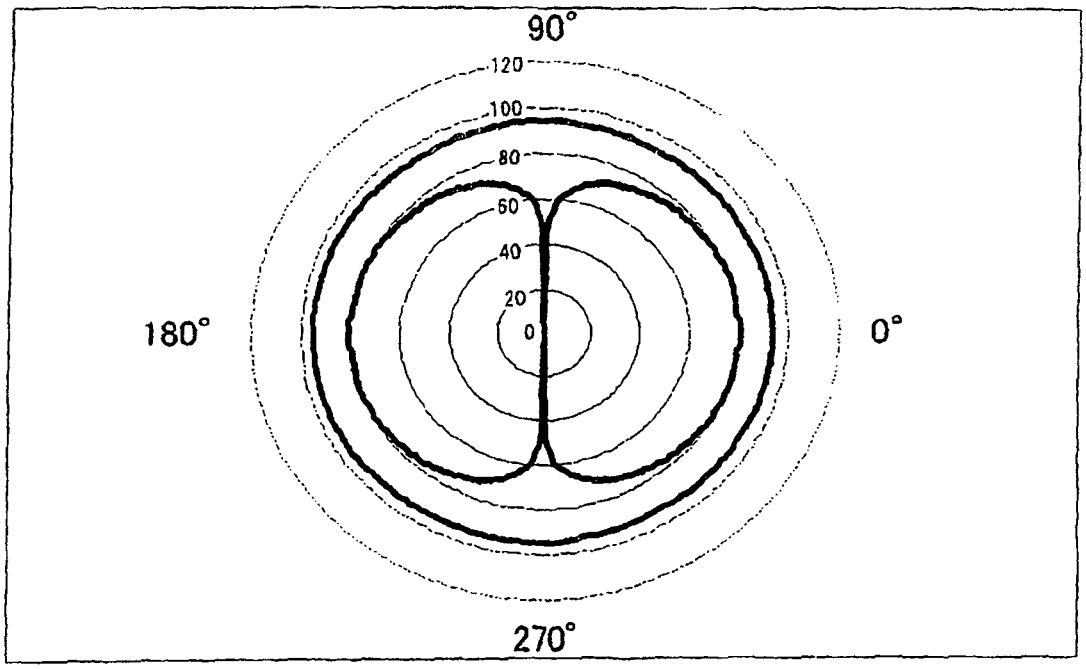
FIG. 35A is a diagram illustrating directivity of a differential microphone in a case where a distance between microphones is 5 mm, a sound source frequency is 300 Hz, and a distance between a microphone and a sound source is 2.5 cm.
Figure 35B:
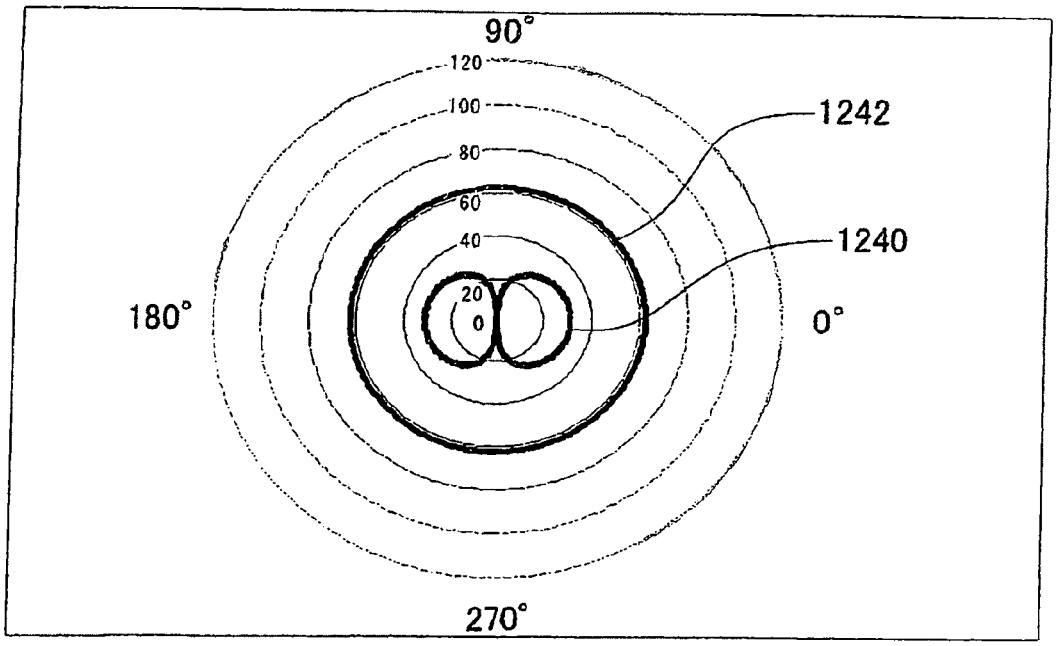
FIG. 35B is a diagram illustrating directivity of a differential microphone in a case where a distance between microphones is 5 mm, a sound source frequency is 300 Hz, and a distance between a microphone and a sound source is 1 m.

FIGS. 35A and 35B are diagrams illustrating directivity of the differential microphone in a case where the sound source frequency is 300 Hz, the distance Δr between the microphones is 5 mm, and the distance between the microphone and the sound source is 2.5 cm and 1 m, respectively. In this case, as shown in FIG. 35B, an area indicated by a graph 1240 indicating the directivity of the differential microphone is included in an area indicated by a graph 1242 indicating the equivalent characteristic of the monolithic microphone, and the differential microphone has an excellent suppression effect of the distant noise compared with the monolithic microphone.

Figure 36A:
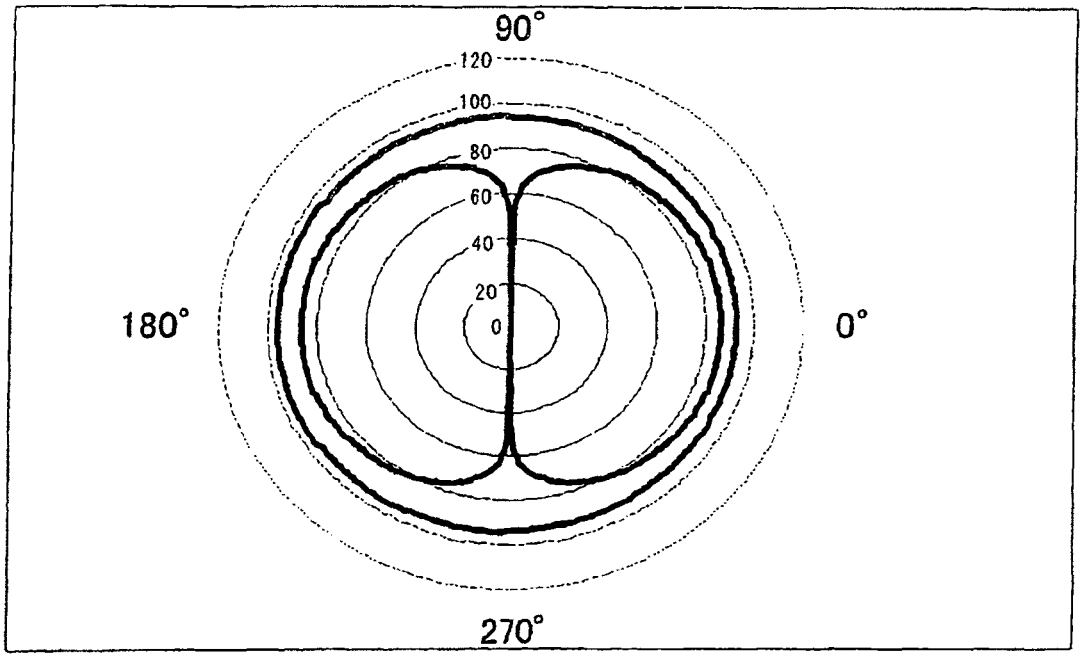
FIG. 36A is a diagram illustrating directivity of a differential microphone in a case where a distance between microphones is 10 mm, a sound source frequency is 300 Hz, and a distance between a microphone and a sound source is 2.5 cm.
Figure 36B:
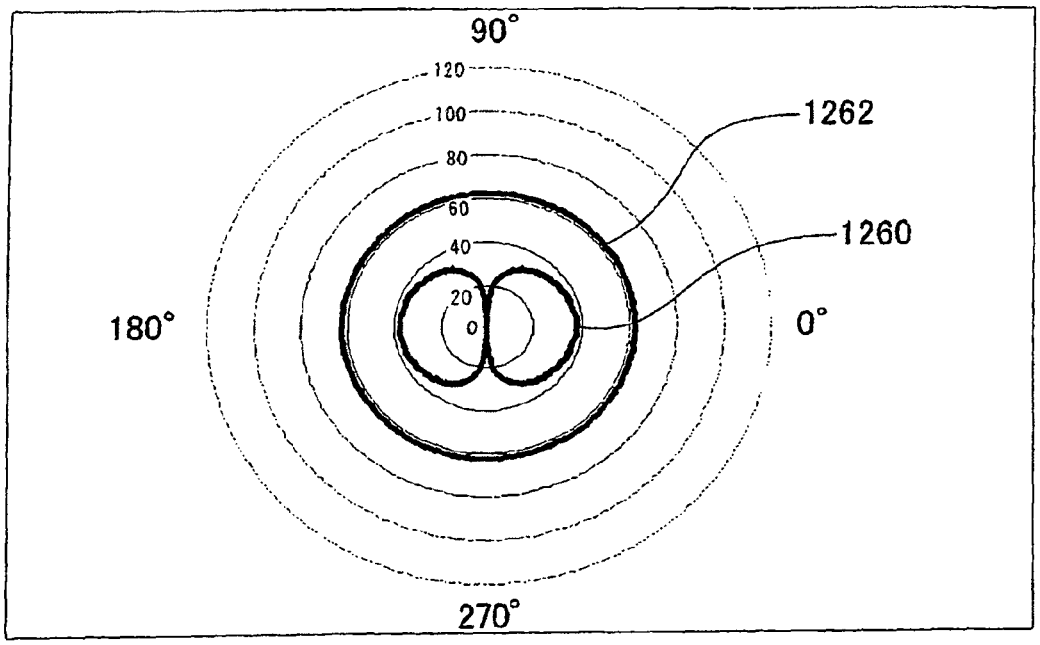
FIG. 36B is a diagram illustrating directivity of a differential microphone in a case where a distance between microphones is 10 mm, a sound source frequency is 300 Hz, and a distance between a microphone and a sound source is 1 m.

FIGS. 36A and 36B are diagrams illustrating directivity of the differential microphone in a case where the sound source frequency is 300 Hz, the distance Δr between the microphones is 10 mm, and the distance between the microphone and the sound source is 2.5 cm and 1 m, respectively. In this case, as shown in FIG. 36B, an area indicated by a graph 1260 indicating the directivity of the differential microphone is also included in an area indicated by a graph 1262 indicating the equivalent characteristic of the monolithic microphone, and the differential microphone has an excellent suppression effect of the distant noise compared with the monolithic microphone.

Figure 37A:
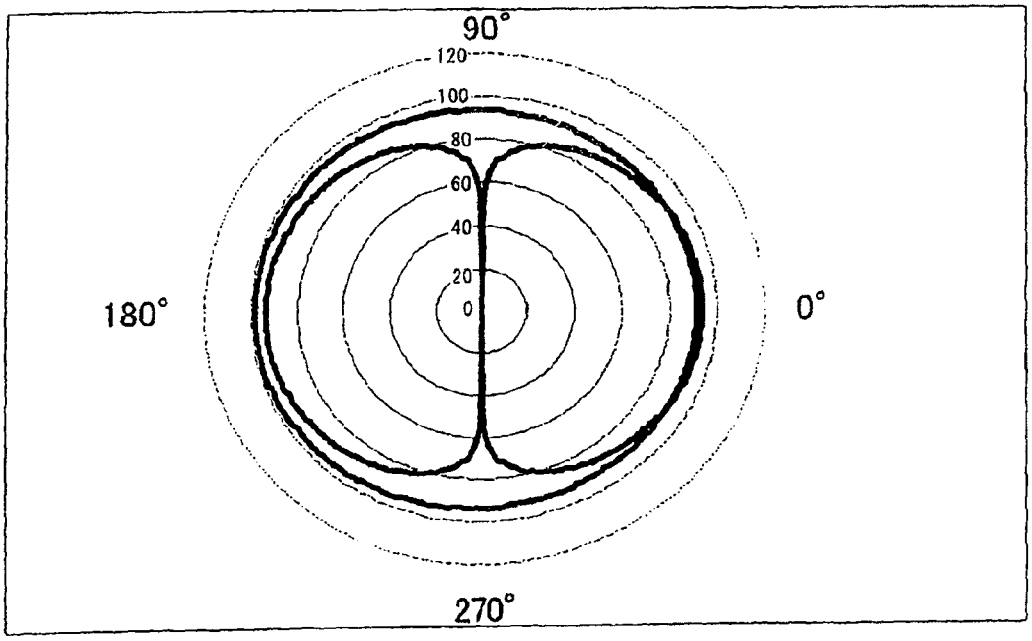
FIG. 37A is a diagram illustrating directivity of a differential microphone in a case where a distance between microphones is 20 mm, a sound source frequency is 300 Hz, and a distance between a microphone and a sound source is 2.5 cm.
Figure 37B:
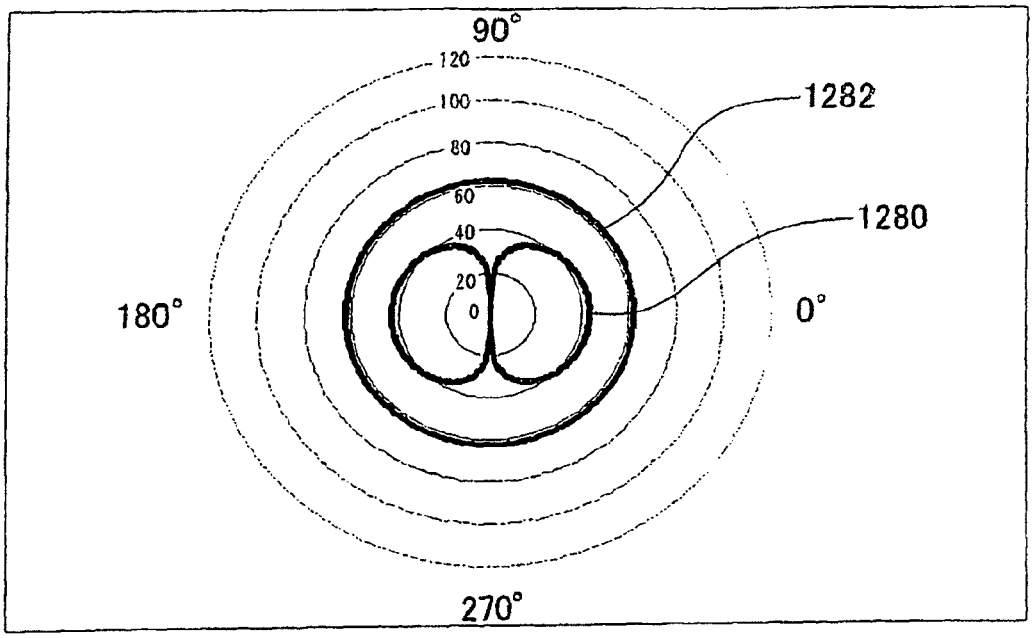
FIG. 37B is a diagram illustrating directivity of a differential microphone in a case where a distance between microphones is 20 mm, a sound source frequency is 300 Hz, and a distance between a microphone and a sound source is 1 m.

FIGS. 37A and 37B are diagrams illustrating directivity of the differential microphone in a case where the sound source frequency is 300 Hz, the distance Δr between the microphones is 20 mm, and the distance between the microphone and the sound source is 2.5 cm and 1 m, respectively. In this case, as shown in FIG. 37B, an area indicated by a graph 1280 indicating the directivity of the differential microphone is included in an area indicated by a graph 1282 indicating the equivalent characteristic of the monolithic microphone, and the differential microphone has an excellent suppression effect of the distant noise compared with the monolithic microphone.

In a case where the distance between microphones is 5 mm and the sound frequency is any one of 1 kHz, 7 kHz and 300 Hz, as shown in FIGS. 29B, 32B and 35B, an area indicated by a graph indicating the directivity of the differential microphone is included in an area indicated by a graph indicating the equivalent characteristic of the monolithic microphone. That is, in a case where the distance between microphones is 5 mm, in a sound frequency band of 7 kHz or less, the differential microphone has an excellent suppression effect of the distant noise compared with the monolithic microphone.

However, in a case where the distance between microphones is 10 mm and the sound frequency is 7 kHz, as shown in FIGS. 30B, 33B, and 36B, an area indicated by a graph indicting directivity of the differential microphone is not included in an area indicated by a graph indicating the equivalent characteristic of the monolithic microphone. That is, in a case where the distance between microphones is 10 mm, in a sound frequency band of about 7 kHz (or 7 kHz or higher), the differential microphone does not have an excellent suppression effect of the distant noise compared with the monolithic microphone.

Further, in a case where the distance between microphones is 20 mm and the sound frequency is 7 kHz, as shown in FIGS. 31B, 34B, and 37B, an area indicated by a graph indicting directivity of the differential microphone is not included in an area indicated by a graph indicating the equivalent characteristic of the monolithic microphone. That is, with respect to a case where the distance between microphones is 20 mm, in a sound frequency band of about 7 kHz (or 7 kHz or higher), the differential microphone does not have an excellent suppression effect of the distant noise compared with the monolithic microphone.

By setting the distance between the microphones of the differential microphone to about 5 mm to 6 mm (more specifically, 5.2 mm or less), the suppression effect of the distant noise in all directions is improved compared with the monolithic microphone, irrespective of the directivity, for the sound of 7 kHz or less. Accordingly, by setting the inter-center distance between the first and second vibrating membranes to about 5 mm to 6 mm (more specifically, 5.2 mm or less), it is possible to realize an integrated circuit device which is capable of suppressing the distant noise in all directions, irrespective of the directivity, for the sound of 7 kHz or less.

The integrated circuit device 1 can also remove the user's voice component which enters the integrated circuit device 1 after being reflected by a wall or the like. Specifically, since a user's voice reflected by a wall or the like enters the integrated circuit device 1 after traveling over a long distance, a sound source of the user's voice can be considered to be distant from the integrated circuit device 1 compared with a sound source of a normal user's voice. Here, since energy of such a user's voice is reduced to a large extent due to the reflection, the sound pressure is not attenuated to a large extent between the first and second vibrating membranes 12 and 22, in a similar way to a noise component. Thus, the integrated circuit device 1 also removes a user's voice component which enters after being reflected by a wall or the like in a similar way to noise (as one type of noise).

Further, according to the integrated circuit device 1, the first and second vibrating membranes 12 and 22 and the differential signal generation circuit 30 are formed on the single semiconductor substrate 100. According to this configuration, the first and second vibrating membranes 12 and 22 can be accurately formed while significantly reducing the inter-center distance between the first and second vibrating membranes 12 and 22. Therefore, it is possible to provide an integrated circuit device having a small size and high noise removal accuracy.

Further, according to the integrated circuit device 1, it is possible to obtain a signal indicating an input voice which does not include noise. Thus, according to the integrated circuit device 1, it is possible to realize a voice recognition process, a voice authentication process, a command generation process with high accuracy.

5. Voice Input Device

Next, a voice input device 2 which includes the integrated circuit device 1 is described below.

(1) Configuration of Voice Input Device

Figure 7:
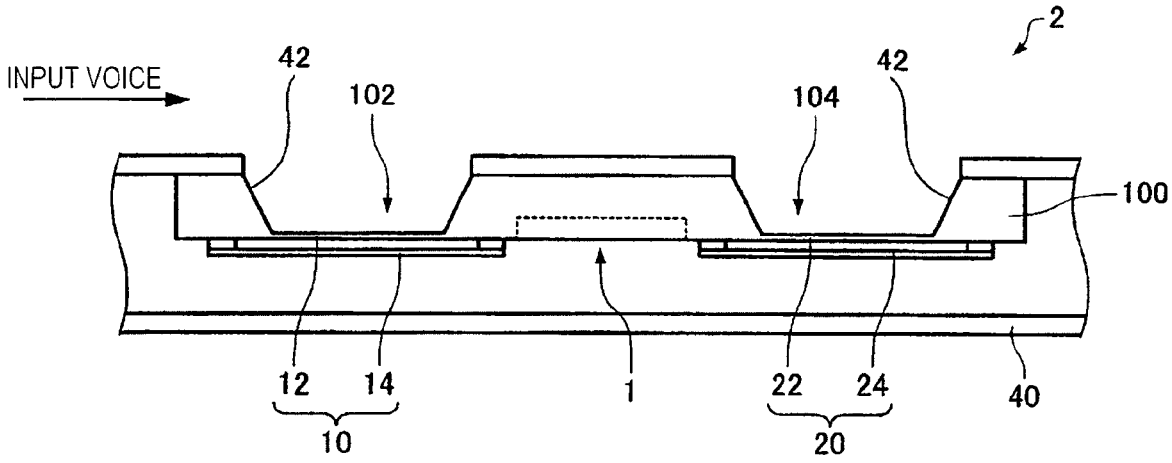
FIG. 7 is a diagram illustrating a voice input device having an integrated circuit device.
Figure 8:
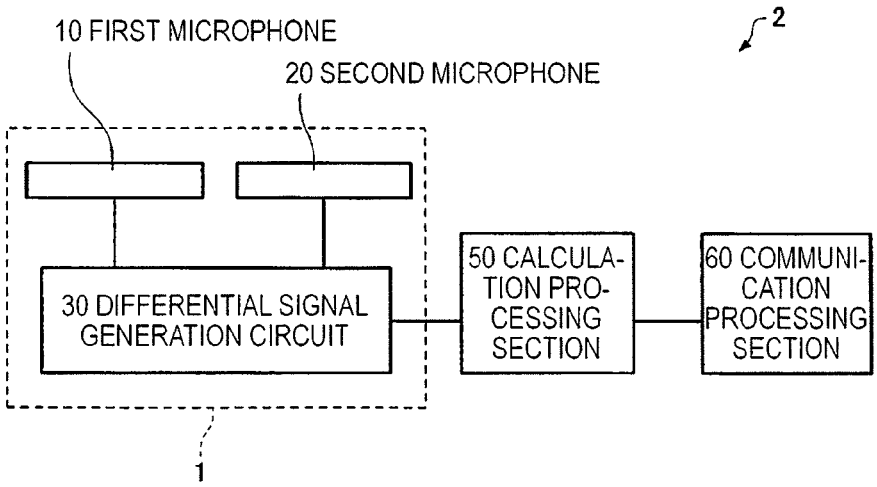
FIG. 8 is a diagram illustrating a voice input device having an integrated circuit device.

First, a configuration of the voice input device 2 will be described. FIGS. 7 and 8 are diagrams illustrating the configuration of the voice input device 2. The voice input device 2 which is described below is a close-talking voice input device, and may be applied to voice communication instruments such as a mobile phone and transceiver, information processing systems utilizing an input voice analysis technique (e.g., voice authentication system, voice recognition system, command generation system, electronic dictionary, translation device, and voice input remote controller), recording instruments, amplifier systems (loudspeaker), microphone systems, or the like.

FIG. 7 is a diagram illustrating a structure of the voice input device 2.

The voice input device 2 includes a housing 40. The housing 40 may be a member which forms the external shape of the voice input device 2. A basic position may be set for the housing 40. This makes it possible to limit the travel path of the input voice (user's voice). The housing 40 may have openings 42 which receives the input voice (user's voice).

In the voice input device 2, the integrated circuit device 1 is disposed in the housing 40. The integrated circuit device 1 may be installed in the housing 40 so that the first and second concave sections 102 and 104 communicate with the openings 42. The integrated circuit device 1 may be installed in the housing 40 so that the first and second vibrating membranes 12 and 22 are disposed at different positions along the travel path of the input voice. In this case, the first vibrating membrane 12 may be disposed on the upstream side of the travel path of the input voice, and the second vibrating membrane 22 may be disposed on the downstream side of the travel path of the input voice.

Then, a function of the voice input device 2 is described below with reference to FIG. 8, which is a block diagram illustrating the function of the voice input device 2.

The voice input device 2 includes the first and second microphones 10 and 20. The first and second microphones 10 and 20 output first and second voltage signals.

The voice input device 2 includes the differential signal generation circuit 30. The differential signal generation circuit 30 receives the first and second voltage signals output from the first and second microphones 10 and 20, and generates a differential signal indicating the difference between the first voltage signal and the second voltage signal.

The first and second microphones 10 and 20, and the differential signal generation circuit 30 are realized in the single semiconductor substrate 100.

The voice input device 2 may include a calculation processing section 50. The calculation processing section 50 performs various calculation processes on the basis of the differential signal generated by the differential signal generation circuit 30. The calculation processing section 50 may perform an analysis process for the differential signal. The calculation processing section 50 may perform a process of specifying a person who has produced the input voice by analyzing the differential signal (so-called voice authentication process). The calculation processing section 50 may perform a process of specifying a content of the input voice by analyzing the differential signal (so-called voice recognition process). The calculation processing section 50 may perform a process of creating various commands on the basis of the input voice. The calculation processing section 50 may perform a process of assigning a predetermined gain (increasing or decreasing the gain) to the differential signal. Further, the calculation processing section 50 may control operation of a communication processing section 60 to be described later. The calculation processing section 50 may realize the above-mentioned functions by signal processing using a CPU or a memory.

The voice input device 2 may further include the communication processing section 60. The communication processing section 60 controls communication between the voice input device and a different terminal (mobile phone terminal, host computer or the like). Further, the communication processing section 60 may have a function of transmitting a signal (differential signal) to a different terminal through a network. Further, the communication processing section 60 may have a function of receiving a signal from a different terminal through a network. Further, for example, a host computer may analyze the differential signal obtained through the communication processing section 60, and perform various types of information processes such as a voice recognition process, a voice authentication process, a command generation process, and a data storage process. That is, the voice input device may form an information processing system in cooperation with a different terminal. In other words, the voice input device may be considered as an information input terminal which forms an information processing system. Here, the voice input device may not include the communication processing section 60.

The calculation processing section 50 and the communication processing section 60 as described above may be disposed in the housing 40 as a packaged semiconductor device (integrated circuit device). However; the invention is not limited thereto. For example, the calculation processing section 50 may be disposed outside the housing 40. In a case where the calculation section 50 is disposed outside the housing 40, the calculation processing section 50 may obtain the differential signal through the communication processing section 60.

The voice input device 2 may further include a display device such as a display panel and a sound output device such as a speaker. Further, the voice input device according to this embodiment may further include an operation key for input of operation information.

The voice input device 2 may be configured as described above. The voice input device 2 utilizes the integrated circuit device 1 as a microphone element (voice input element). Thus, the voice input device 2 can obtain a signal indicating an input voice which does not include noise, and can realize a voice recognition process, a voice authentication process, and a command generation process with high accuracy.

Further, when the voice input device 2 is applied to a microphone system, a user's voice output from a speaker is also removed as noise. Accordingly, it is possible to provide a microphone system which rarely howls.

6. Modified Embodiments

Hereinafter, modified embodiments to the embodiment of the present invention will be described.

Figure 9:
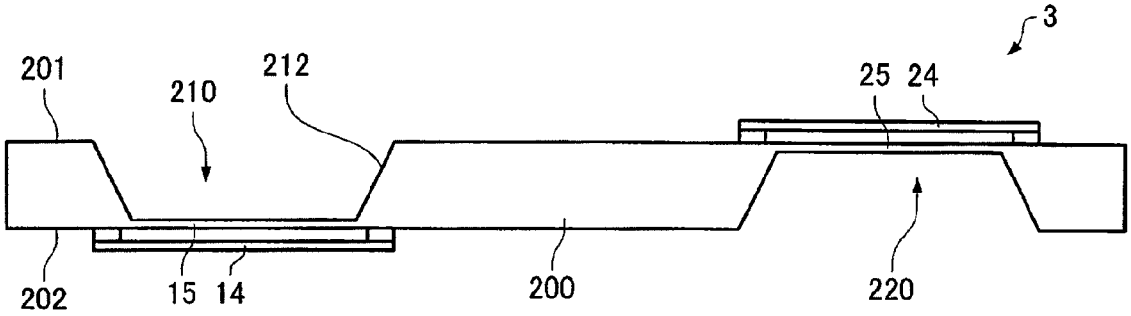
FIG. 9 is a diagram illustrating an integrated circuit device according to a modified embodiment.

FIG. 9 is a diagram illustrating an integrated circuit device 3 according to this embodiment.

As shown in FIG. 9, the integrated circuit device 3 according to this modified embodiment includes a semiconductor substrate 200. First and second vibrating membranes 15 and 25 are formed on the semiconductor substrate 200. The first vibrating membrane 15 forms the bottom of a first concave section 210 formed in a first surface 201 of the semiconductor substrate 200. Further, the second vibrating membrane 25 forms the bottom of a second concave section 220 formed in a second surface 202 (surface opposite to the first surface 201) of the semiconductor substrate 200. That is, according to the integrated circuit device 3 (semiconductor substrate 200), the first and second vibrating membranes 15 and 25 are disposed at different positions in a normal direction (in a direction of the thickness of the semiconductor substrate 200). The first and second vibrating membranes 15 and 25 may be disposed on the semiconductor substrate 200 so that the distance between a normal direction to the first vibrating membrane 15 and a normal direction to the second vibrating membrane 25 is 5.2 mm or less. That is, the first and second vibrating membranes 15 and 25 may be disposed so that the inter-center distance is 5.2 mm or less.

Figure 10:
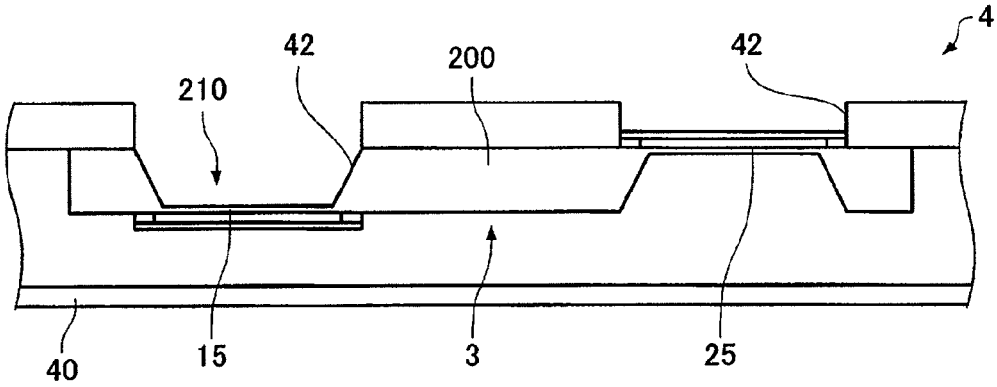
FIG. 10 is a diagram illustrating a voice input device having an integrated circuit device according to a modified embodiment.

FIG. 10 is a diagram illustrating a voice input device 4 in which the integrated circuit device 3 is installed. The integrated circuit device 3 is installed in a housing 40. As shown in FIG. 10, the integrated circuit device 3 may be installed in the housing 40 so that the first surface 201 faces the surface of the housing 40 in which openings 42 are formed. Further, the integrated circuit device 3 may be installed in the housing 40 so that the first concave section 210 communicates with the opening 42 and the second vibrating membrane 25 overlaps with the opening 42.

In this modified embodiment, the integrated circuit device 3 may be disposed so that the center of an opening 212 which communicates with the first concave section 210 is disposed at a position closer to the input voice source than the center of the second vibrating membrane 25 (the bottom of the second concave section 220). The integrated circuit device 3 may be disposed so that the input voice reaches the first and second vibrating membranes 15 and 25 at the same time. For example, the integrated circuit device 3 may be disposed so that the distance between the input voice source (model sound source) and the first vibrating membrane 15 is equal to the distance between the model sound source and the second vibrating membrane 25. The integrated circuit device 3 may be disposed in the housing having a basic position set so that the above-described conditions are satisfied.

The voice input device according to this embodiment can reduce the difference between entrance times of the input voice (user's voice) incident on the first and second vibrating membranes 15 and 25. Thus, since the differential signal can be generated so that the differential signal does not include the phase difference component of the input voice, the amplitude component of the input voice can be accurately extracted.

Since sound waves are not diffused inside the concave section (first concave section 210), the amplitude of the sound waves is hardly attenuated. Thus, in the voice input device, the intensity (amplitude) of the input voice which causes the first vibrating membrane 15 to vibrate can be considered to be the same as the intensity of the input voice in the opening 212. Accordingly, even in a case where the voice input device is configured so that the input voice reaches the first and second vibrating membranes 15 and 25 at the same time, the input voice which causes the first vibrating membrane 15 to vibrate differs in intensity from the input voice that causes the second vibrating membrane 25 to vibrate. As a result, the input voice can be extracted by obtaining the differential signal indicating the difference between the first voltage signal and the second voltage signal.

In summary, the voice input device can obtain the amplitude component (differential signal) of the input voice so that noise based on the phase difference component of the input voice is excluded. This makes it possible to realize a noise removal function with high accuracy.

Figure 11:
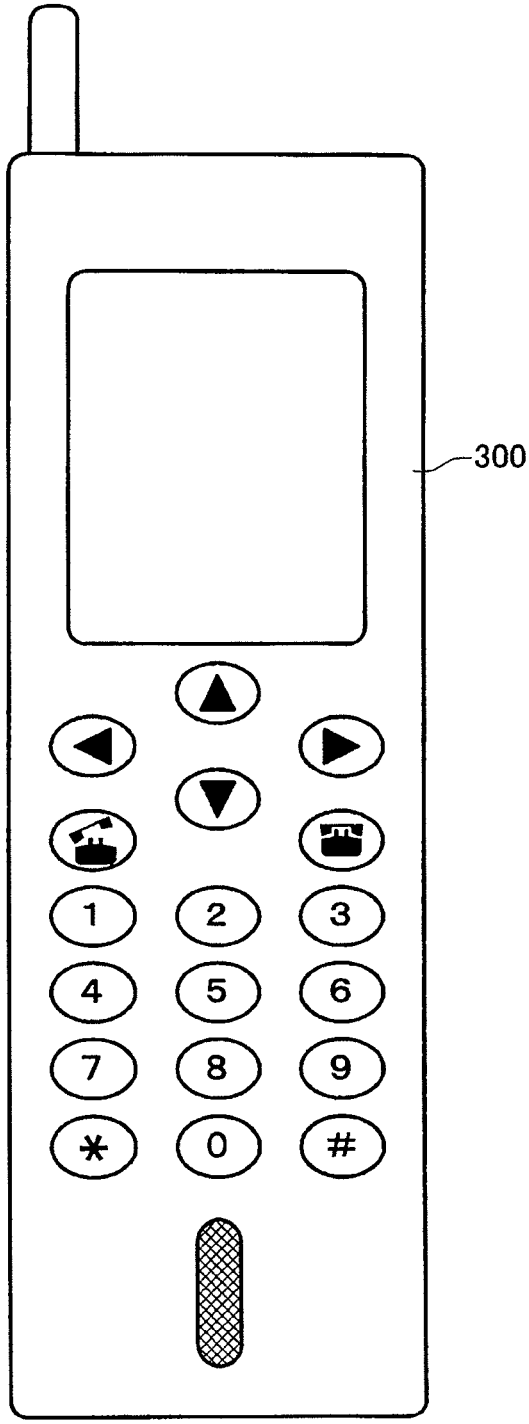
FIG. 11 is a diagram illustrating a mobile phone as an example of a voice input device having an integrated circuit device.
Figure 12:
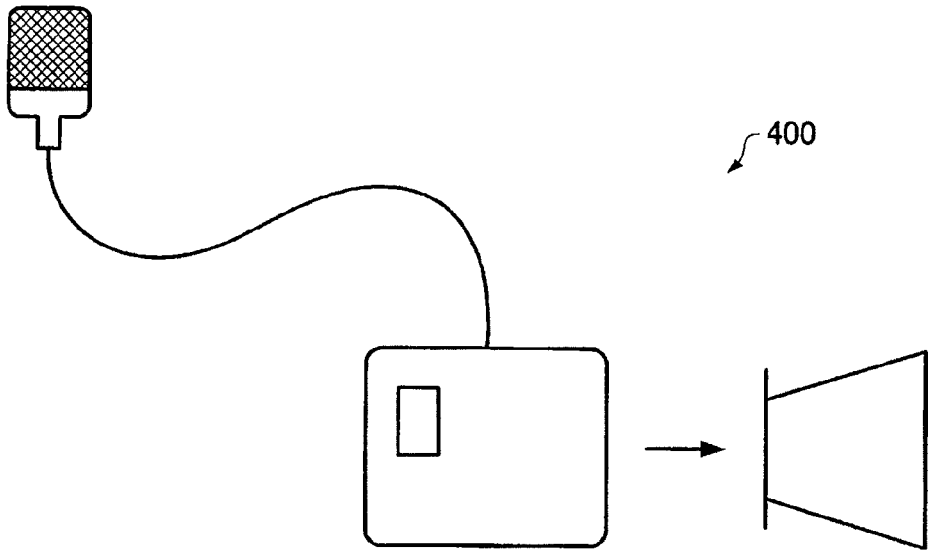
FIG. 12 is a diagram illustrating a microphone as an example of a voice input device having an integrated circuit device.
Figure 13:
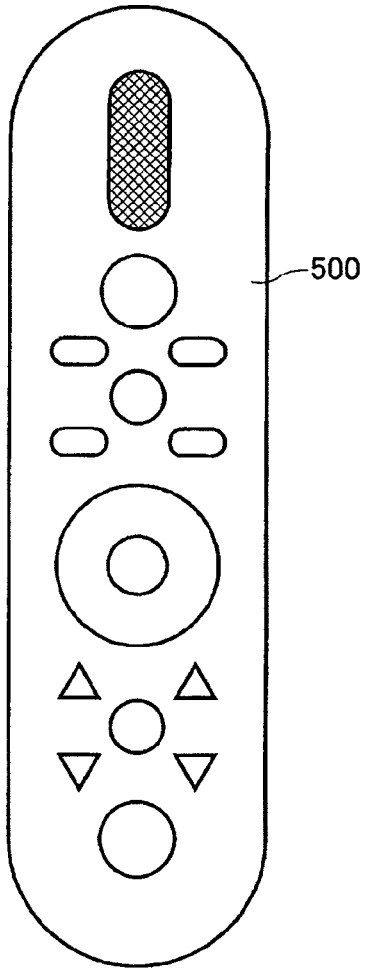
FIG. 13 is a diagram illustrating a remote controller as an example of a voice input device having an integrated circuit device.
Figure 14:
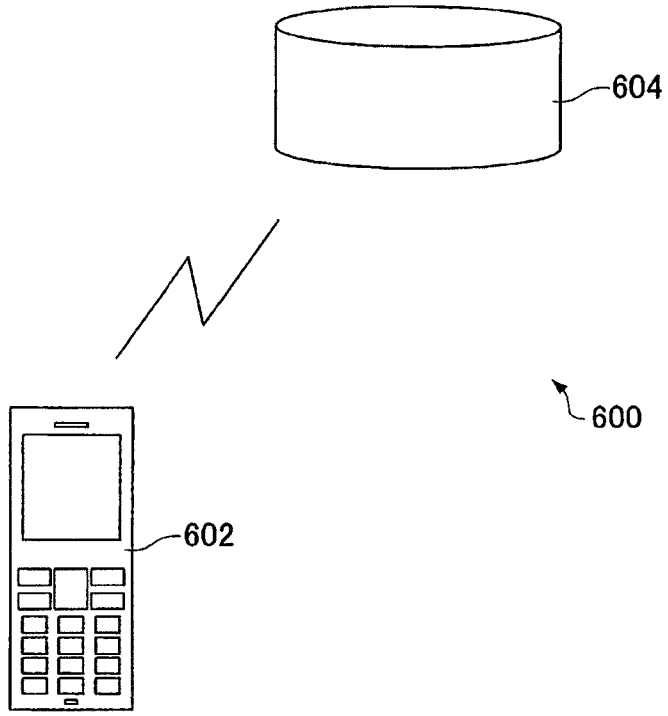
FIG. 14 is a diagram schematically illustrating an information processing system.

Finally, FIGS. 11 to 13 respectively illustrate a mobile phone 300, a microphone (microphone system) 400, and a remote controller 500, as examples of the voice input device according to the embodiment of the invention. Further, FIG. 14 is a schematic view of an information processing system 600 which includes a voice input device 602 which is an information input terminal and a host computer 604.

7. Configuration of Integrated Circuit Device

In the above-described embodiments, the first vibrating membrane which forms the first microphone, the second vibrating membrane which forms the second microphone and the differential signal generation circuit are formed on the semiconductor substrate. However, the present invention is not limited thereto. The present invention encompasses any integrated circuit device which includes a wiring board which includes a first vibrating membrane which forms a first microphone, a second vibrating membrane which forms a second microphone, and a differential signal generation circuit which receives a first voltage signal obtained by the first microphone and a second voltage signal obtained by the second microphone and generates a differential signal indicating the difference between the first and second voltage signals. The first vibrating membrane, the second vibrating membrane and the differential signal generation circuit may be formed in the substrate, or may be mounted on the wiring board in a flip-chip mounting method or the like.

The wiring board may be a semiconductor substrate, or may be a different wiring board made of glass epoxy or the like.

The difference in characteristics between two microphones due to the environment such as temperature can be suppressed by forming the first vibrating membrane and the second vibrating membrane on a single substrate. The differential signal generation circuit may have a function of adjusting the gain balance between two microphones. Thus, gain variation between two microphones can be adjusted corresponding to each substrate for shipping.

Figure 15:
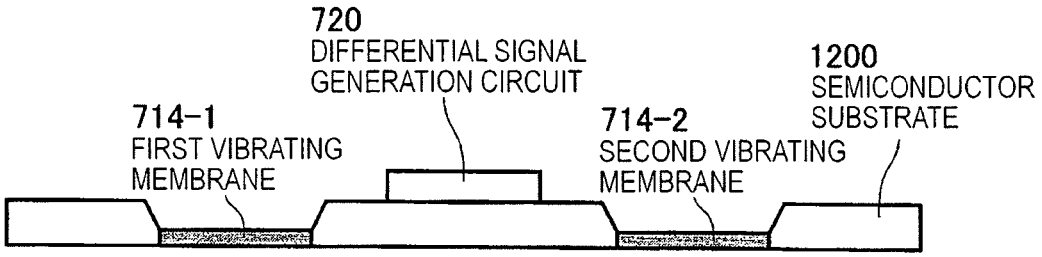
FIG. 15 is a diagram illustrating another configuration of an integrated circuit device.
Figure 16:
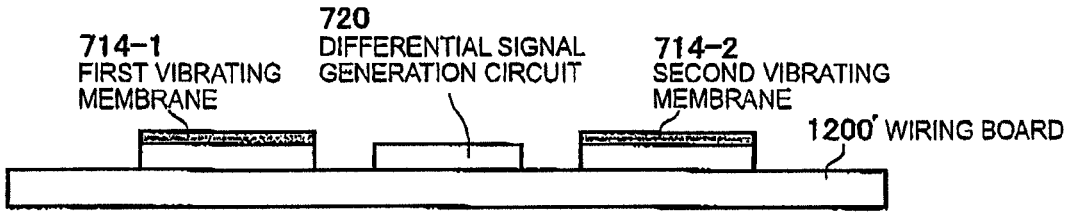
FIG. 16 is a diagram illustrating another configuration of an integrated circuit device.
Figure 17:
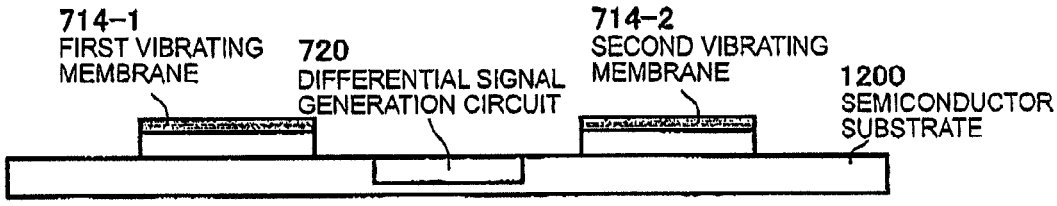
FIG. 17 is a diagram illustrating another configuration of an integrated circuit device.

FIGS. 15 to 17 illustrate other configurations of the integrated circuit device according to this embodiment.

In the integrated circuit device according to this embodiment, as shown in FIG. 15, the wiring board is a semiconductor substrate 1200, a first vibrating membrane 714-1 and a second vibrating membrane 714-2 are formed on the semiconductor substrate 1200, and a differential signal generation circuit 720 is mounted on the semiconductor substrate 1200 in a flip chip mounting method.

The term "flip-chip mounting" refers to a mounting method which directly and electrically connects an integrated circuit (IC) element or an IC chip to a substrate in a batch in a state where a circuit surface of the IC element or IC chip faces the substrate. Here, the surface of the chip is electrically connected to the substrate through protruding terminals called bumps that are disposed in an array shape, not through wire bonding. Thus, the mounting area can be reduced compared with the wire bonding.

The difference in characteristics between two microphones due to the environment such as temperature can be suppressed by forming the first vibrating membrane 714-1 and the second vibrating membrane 714-2 on the same semiconductor substrate 1200.

Further, in the integrated circuit device according to this embodiment, as shown in FIG. 16, the first vibrating membrane 714-1, the second vibrating membrane 714-2 and the differential signal generation circuit 720 may be mounted on a wiring board 1200' in a flip chip mounting method. The wiring board 1200' may be a semiconductor substrate, or may be a different wiring board made of glass epoxy or the like.

Further, in the integrated circuit device according to this embodiment, as shown in FIG. 17, the wiring board is the semiconductor substrate 1200, in which the differential signal generation circuit 720 may be formed on the semiconductor substrate 1200, and the first vibrating membrane 714-1 and the second vibrating membrane 714-2 may be mounted on the semiconductor substrate 1200 in a flip chip mounting method.

Figure 18:
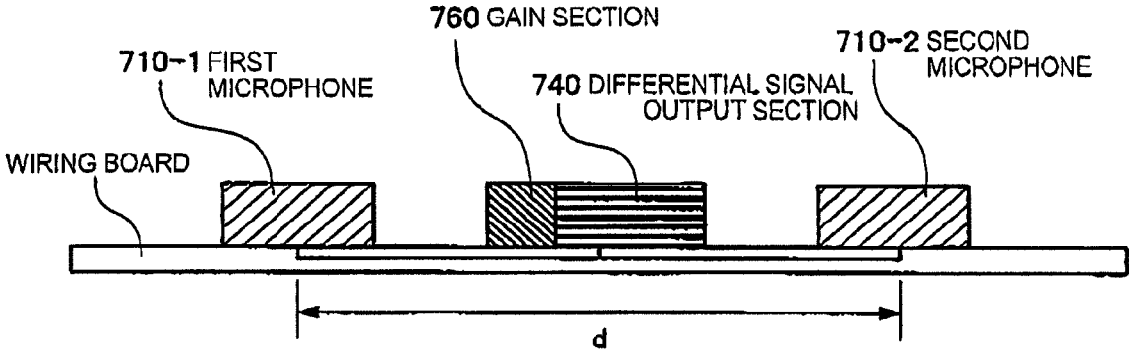
FIG. 18 is a diagram illustrating an example of a configuration of an integrated circuit device.
Figure 19:
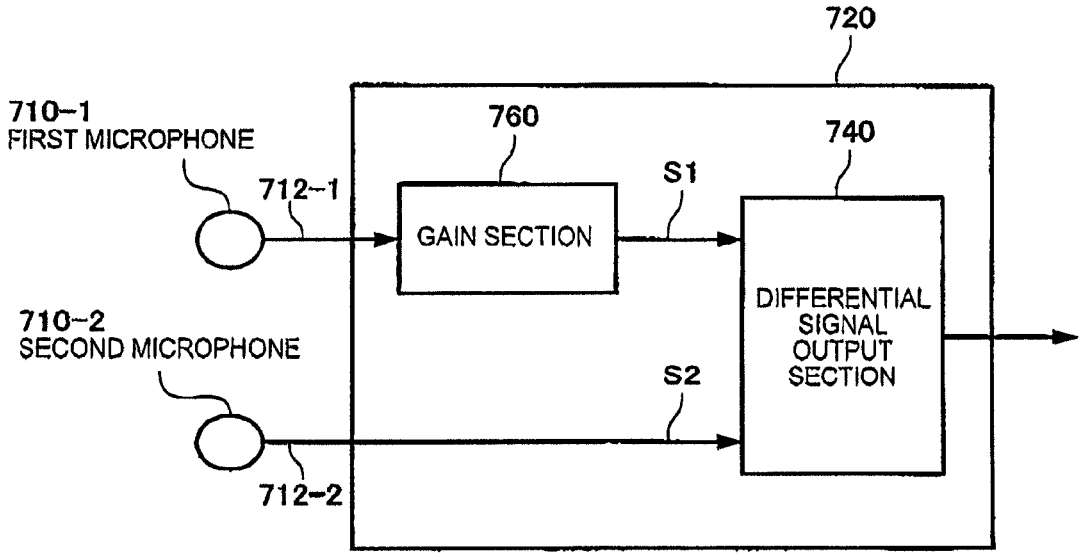
FIG. 19 is a diagram illustrating an example of a configuration of an integrated circuit device.

FIGS. 18 and 19 illustrate an example of a configuration of the integrated circuit device according to this embodiment.

An integrated circuit device 700 according to this embodiment includes a first microphone 710-1 having a first vibrating membrane. Further, the integrated circuit device 700 according to this fourth embodiment includes a second microphone 710-2 having a second vibrating membrane.

The first vibrating membrane of the first microphone 710-1 and the second vibrating membrane of the second microphone 710-2 are disposed so that a noise intensity ratio indicating the ratio of the intensity of a noise component included in a differential signal 742 to the intensity of the noise component included in a first voltage signal 712-1 or a second voltage signal 712-2, is smaller than an input voice intensity ratio indicating the ratio of the intensity of an input voice component included in the differential signal 742 to the intensity of the input voice component contained in the first voltage signal 712-1 or the second voltage signal 712-2.

The integrated circuit device 700 according to this embodiment includes a differential signal generation section 720 which generates a differential signal 742 indicating the difference between the first voltage signal 712-1 obtained by the first microphone 710-1 and the second voltage signal 712-1 obtained by the second microphone 710-2, on the basis of the first voltage signal 712-1 and the second voltage signal 712-2.

Further, the differential signal generation section 720 includes a gain section 760. The gain section 760 gives a predetermined gain to the first voltage signal obtained by the first microphone 710-1, and outputs the resulting signal.

Further, the differential signal generation section 720 includes a differential signal output section 740. The differential signal output section 740 receives a first voltage signal S1 given a predetermined gain by the gain section 760 and a second voltage signal obtained by the second microphone, generates a differential signal indicating the difference between the first voltage signal S1 and the second voltage signal, and outputs the differential signal.

Since the first voltage signal and the second voltage signal can be corrected by giving a predetermined gain to the first voltage signal 712-1 so that the difference in amplitude between the first voltage signal and the second voltage signal due to the difference in sensitivity between two microphones is removed, it is possible to prevent deterioration in the noise suppression effect.

Figure 20:
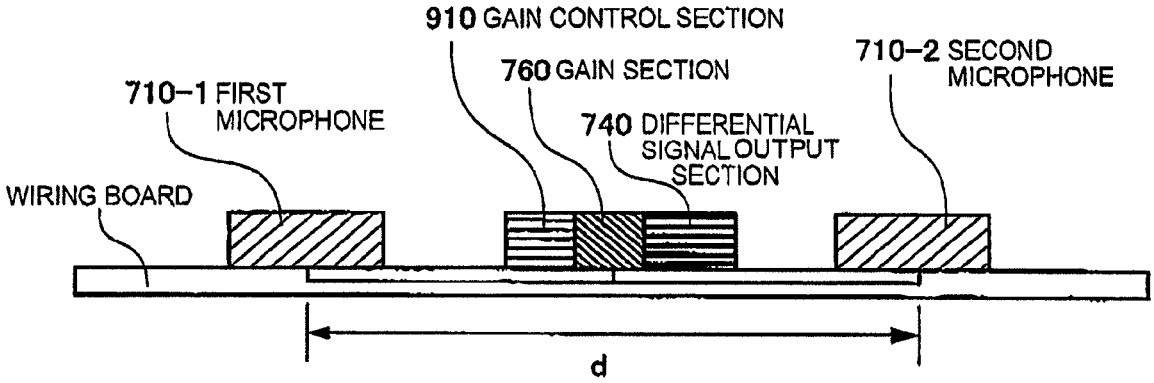
FIG. 20 is a diagram illustrating an example of a configuration of an integrated circuit device.
Figure 21:
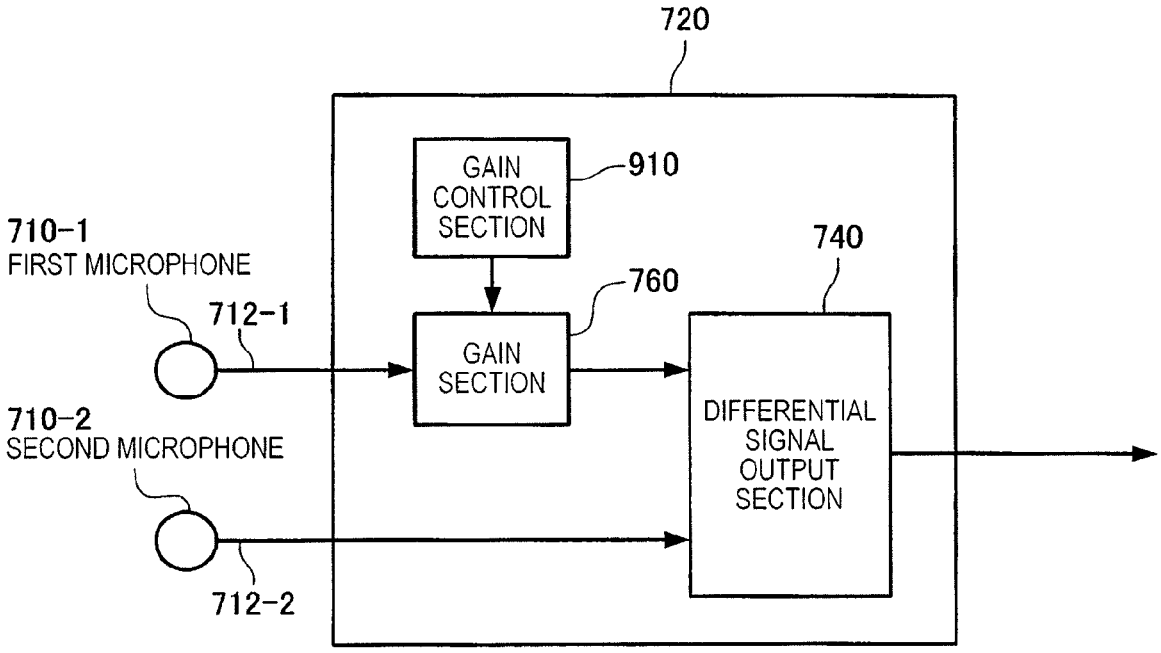
FIG. 21 is a diagram illustrating an example of a configuration of an integrated circuit device.

FIGS. 20 and 21 respectively illustrate an example of a configuration of the integrated circuit device according to this embodiment.

The differential signal generation section 720 according to this embodiment may include a gain control section 910. The gain control section 910 performs a control of changing the gain of the gain section 760. The balance between the amplitude of the output S1 from the gain section and the amplitude of the second voltage signal 712-2 obtained by the second microphone may be adjusted by causing the gain control section 910 to dynamically or statically control the gain of the gain section 760.

Figure 22:
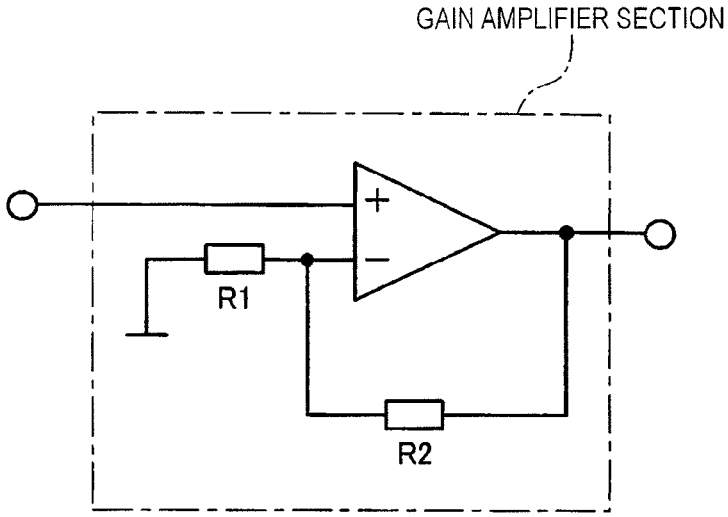
FIG. 22 is a diagram illustrating an example of a specific configuration of a gain section and a gain control section.

FIG. 22 illustrates an example of a specific configuration of the gain section and the gain control section. For example, when processing an analog signal, the gain section 760 may be formed by an analog circuit such as an operational amplifier (for example, a non-inverting amplifier circuit in FIG. 22). The amplification factor of the operational amplifier may be controlled by dynamically or statically controlling the voltage applied to a (−) terminal of the operational amplifier by changing resistance values of resistors R1 and R2 or setting the resistance values of the resistors R1 and R2 to predetermined values during manufacturing.

Figure 23A:
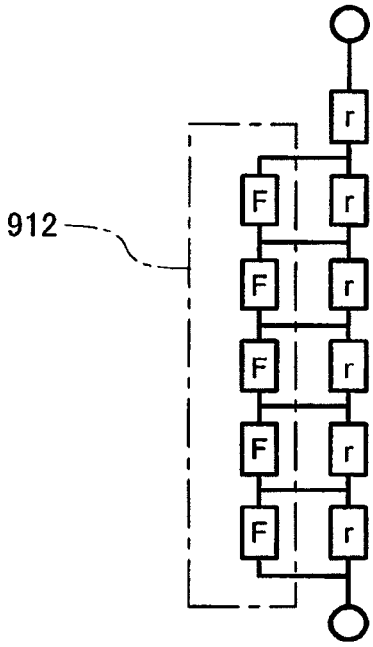
FIG. 23A is a diagram illustrating an example of a configuration of statically controlling an amplification factor of a gain section.
Figure 23B:
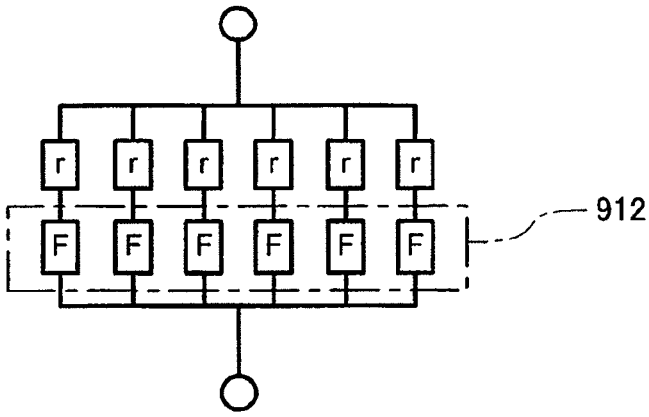
FIG. 23B is a diagram illustrating an example of a configuration of statically controlling an amplification factor of a gain section.

FIGS. 23A and 23B respectively illustrate an example of a configuration which statically controls the amplification factor of the gain section.

For example, as shown in FIG. 23A, the resistor R1 or R2 in FIG. 22 may include a resistor array in which a plurality of resistors are connected in series, and a predetermined voltage may be applied to a predetermined terminal ((−) terminal in FIG. 22) of the gain section through the resistor array. The resistors or conductors (F indicated by a reference numeral 912) which form the resistor array may be cut using laser or fused by application of a high voltage or a high electric current during the manufacturing process so that the resistors have resistance values which realize an appropriate amplification factor.

Further, for example, as shown in FIG. 23B, the resistor R1 or R2 in FIG. 32 may include a resistor array in which a plurality of resistors are connected in parallel, and a predetermined voltage may be applied to a predetermined terminal ((−) terminal in FIG. 22) of the gain section through the resistor array. The resistors or conductors (F indicated by the reference numeral 912) which form the resistor array may be cut using laser or fused by application of a high voltage or a high electric current during the manufacturing process so that the resistors have resistance values which realize an appropriate amplification factor.

Here, the appropriate amplification value may be set to a value which cancels the gain balance of the microphone occurred during the manufacturing process. A resistance value corresponding to the gain balance of the microphone occurred during the manufacturing process can be achieved by utilizing the resistor array in which a plurality of resistors are connected in series or parallel as shown in FIGS. 23A and 23B. The resistor array is connected to the predetermined terminal and functions as a gain control section which controls the gain of the gain section.

In this embodiment, a plurality of resistors (r) is connected through fuses (F) as an example. However, the present invention is not limited thereto. For example, the plurality of resistors (r) may be connected in series or parallel without using the fuses (F). In this case, at least one resistor may be cut.

Figure 25:
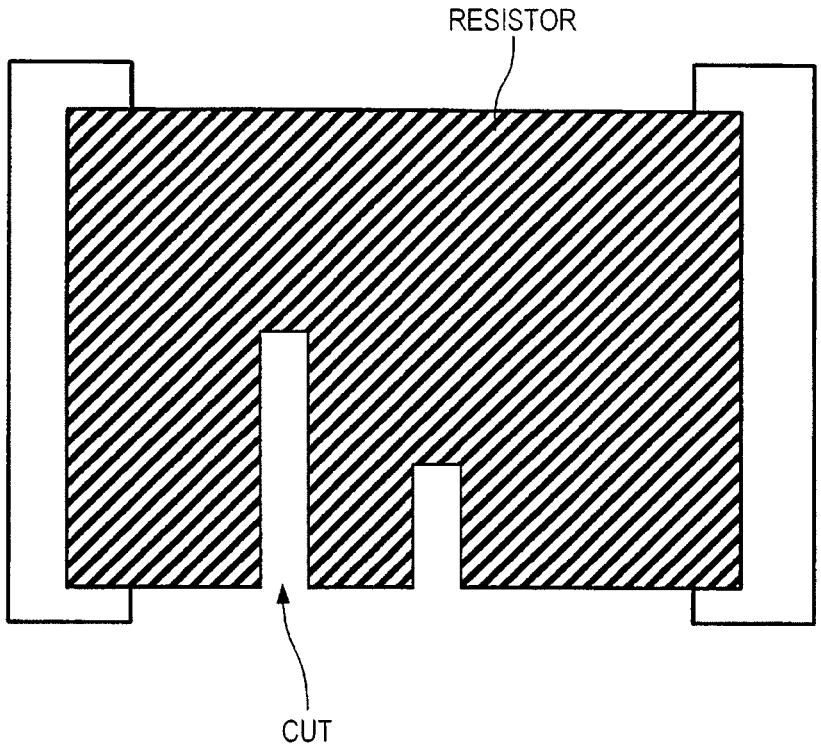
FIG. 25 is a diagram illustrating an example of adjustment of a resistance value by laser trimming.

Further, for example, the resistor R1 or R2 in FIG. 23 may be formed by a single resistor as shown in FIG. 25, and the resistance value may be adjusted by so-called laser trimming which cuts part of the resistor.

Further, the resistor may employ a printed resistor formed by patterning the resistor on the wiring board on which the microphone 710 is mounted by spraying or the like, and then the trimming may be performed. Further, it is more preferable that the resistor is installed on the inner surface of the housing of a microphone unit, in order to perform the trimming in an actual operation in a state where the microphone unit is completed.

Figure 24:
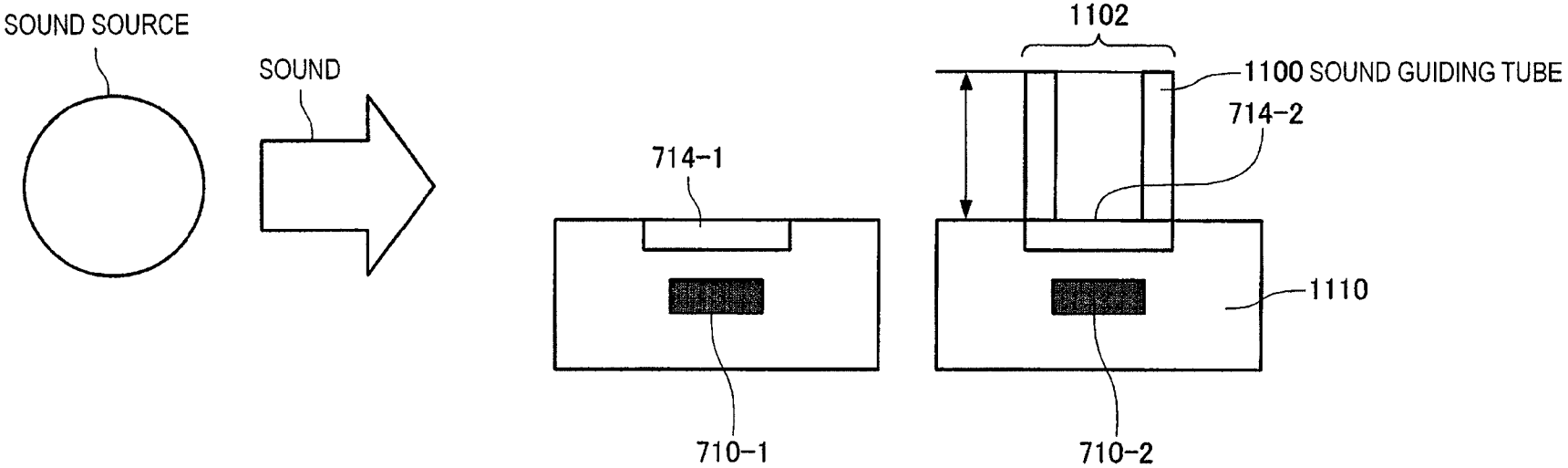
FIG. 24 is a diagram illustrating an example of another configuration of an integrated circuit device.

FIG. 24 illustrates an example of another configuration of the integrated circuit device according to this embodiment.

The integrated circuit device according to this embodiment may include the first microphone 710-1 which includes the first vibrating membrane, the second microphone 710-2 which includes the second vibrating membrane, and the differential signal generation section (not shown) which generates the differential signal indicating the difference between the first voltage signal obtained by the first microphone and the second voltage signal obtained by the second microphone. At least one of the first vibrating membrane and the second vibrating membrane may obtain sound waves through a sound guiding tube 1100 installed perpendicularly to the surface of the vibrating membrane.

The sound guiding tube 1100 may be installed on a substrate 1110 around the vibrating membrane so that sound waves which is incident through an opening 1102 of the tube reach the vibrating membrane of the second microphone 710-2 through a sound hole 714-2 without leaking to the outside. Thus, sound entered the sound guiding tube 1100 reaches the vibrating membrane of the second microphone 710-2 without being attenuated. According to this embodiment, the travel distance of sound until the sound reaches the vibrating membrane can be changed by installing the sound guiding tube corresponding to at least one of the first vibrating membrane and the second vibrating membrane. Accordingly, a delay can be canceled by installing a sound guiding tube having an appropriate length (for example, several millimeters) according to variation in delay balance.

The invention is not limited to the above-described embodiments. Various modifications may be made. The invention includes configurations that are substantially the same as the configurations described in the above embodiments (for example, in function, method and result, or in object and effect). Further, the invention also includes a configuration in which a non-essential element of the above embodiments is replaced by another element. In addition, the invention includes a configuration having the same effects as those of the configurations described in the above embodiments, or a configuration capable of achieving the same object as those of the above-described configurations. The invention further includes a configuration obtained by adding known technology to the configurations described in the above embodiments.

Further, this application claims priority from Japanese Patent Application Number 2008-132460, filed on May 20, 2008, the disclosure of which is incorporated herein by reference.

REFERENCE SIGNS LIST

1: INTEGRATED CIRCUIT DEVICE
2: VOICE INPUT DEVICE
3: INTEGRATED CIRCUIT DEVICE
4: VOICE INPUT DEVICE
10: FIRST MICROPHONE
12: SECOND MICROPHONE
14: FIRST ELECTRODE
15: FIRST VIBRATING MEMBRANE
16: INTEGRATED CIRCUIT
20: SECOND MICROPHONE
22: SECOND VIBRATING MEMBRANE
24: SECOND ELECTRODE
25: SECOND VIBRATING MEMBRANE
30: DIFFERENTIAL SIGNAL GENERATION CIRCUIT
40: HOUSING
42: OPENING
50: CALCULATION PROCESSING SECTION
60: COMMUNICATION PROCESSING SECTION
100: SEMICONDUCTOR SUBSTRATE
102: FIRST CONCAVE SECTION
104: SECOND CONCAVE SECTION
200: SEMICONDUCTOR SUBSTRATE
201: FIRST SURFACE
202: SECOND SURFACE
210: FIRST CONCAVE SECTION
212: OPENING
220: SECOND CONCAVE SECTION
300: MOBILE TERMINAL
400: MICROPHONE
500: REMOTE CONTROLLER
600: INFORMATION PROCESSING SYSTEM
602: VOICE INPUT DEVICE
604: HOST COMPUTER
710-1: FIRST MICROPHONE
710-2: SECOND MICROPHONE
712-1: FIRST VOLTAGE SIGNAL
712-2: SECOND VOLTAGE SIGNAL
714-1: FIRST VIBRATING MEMBRANE
714-2: SECOND VIBRATING MEMBRANE
720: DIFFERENTIAL SIGNAL GENERATION CIRCUIT
760: GAIN SECTION
740: DIFFERENTIAL SIGNAL OUTPUT SECTION
910: GAIN CONTROL SECTION
1100: SOUND GUIDING TUBE
1200: SEMICONDUCTOR SUBSTRATE
1200': WIRING BOARD

What is claimed is:

1. An integrated circuit device having a circuit board, the circuit board comprising:

a first vibrating membrane which forms a first microphone;

a second vibrating membrane which forms a second microphone; and a differential signal generating circuit which receives a first voltage signal obtained in the first microphone and a second voltage signal obtained in the second microphone and generates a differential signal indicating a difference between the first and second voltage signals, wherein an inter-center distance between the first and second vibrating membranes is set to a distance in which a phase component of a voice intensity ratio which is a ratio of the intensity of a differential sound pressure of a voice entering the first and second vibrating membranes to the intensity of a sound pressure of a voice entering the first vibrating membrane, with respect to voice in a frequency band of 10 kHz or less, is equal to or smaller than zero decibels, wherein a value of $\Delta r/\lambda$ is set so that a value of $\rho(N)$ is zero or less in the following expression:

$$20 \log \rho(N)=20 \log|2 \sin(\alpha/2)|; \text{ and}$$

$$\alpha=2\pi\Delta r/\lambda,$$

where $\rho(N)$ is a noise intensity ratio which is a ratio of the intensity of a noise component included in the differential signal to the intensity of a noise component included in the first or second voltage signal, $\Delta r$ is an inter-center distance between the first and second vibrating membranes and $\lambda$ is a wavelength of a noise.

2. The integrated circuit device according to claim 1, wherein an inter-center distance between the first and second vibrating membranes is 5.2 mm or less.

3. The integrated circuit device according to claim 1, wherein the vibrating membranes are formed of vibrators having an SN ratio of about 60 decibels or higher.

4. The integrated circuit device according to claim 1, wherein an inter-center distance between the first and second vibrating membranes is set to a distance in which a voice intensity ratio which is the ratio of the intensity of phase component of differential sound pressure of a voice entering the first and second vibrating membranes to the intensity of amplitude component of differential sound pressure of a voice entering the first vibrating membrane is equal to or smaller than zero decibels.

5. The integrated circuit device according to claim 1, wherein an inter-center distance between the first and second vibrating membranes is set to a distance range in which a sound pressure in a case where the vibrating membranes are used as a differential microphone is not higher than a sound pressure in a case where the vibrating membranes are used as monolithic microphones in all directions, with respect to a voice in an extraction target frequency band.

6. The integrated circuit device according to claim 1, wherein the first and second vibrating membranes are formed so that a normal direction to the first vibrating membrane and a normal direction to the second vibrating membrane are parallel with each other.

7. The integrated circuit device according to claim 1, wherein the differential signal generating circuit includes:

a gain section which gives a predetermined gain to the first voltage signal obtained in the first microphone; and a differential signal output section which generates and outputs, if the first voltage signal with the predetermined gain given by the gain section and the second voltage signal obtained in the second microphone are input, a differential signal between the first voltage signal with the given predetermined gain and the second voltage signal.

* * * * *